US007531282B2

(12) United States Patent
Tokutake et al.

(10) Patent No.: US 7,531,282 B2
(45) Date of Patent: May 12, 2009

(54) ORGANIC PHOTORECEPTOR, IMAGE FORMING APPARATUS, IMAGE FORMING METHOD AND PROCESS CARTRIDGE

(75) Inventors: Shigeaki Tokutake, Hachioji (JP); Yoshihiko Eto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 335 days.

(21) Appl. No.: 11/318,901

(22) Filed: Dec. 27, 2005

(65) Prior Publication Data

US 2006/0188798 A1 Aug. 24, 2006

(30) Foreign Application Priority Data

Feb. 21, 2005 (JP) ..... 2005-043795

(51) Int. Cl.
*G03G 15/08* (2006.01)

(52) U.S. Cl. ..... 430/123.43; 430/123.4; 430/123.41

(58) Field of Classification Search ..... 430/123.4, 430/123.43, 123.41
See application file for complete search history.

(56) References Cited

U.S. PATENT DOCUMENTS 4,518,669 A * 5/1985 Yashiki ..... 430/57.1
4,657,835 A * 4/1987 Yashiki ..... 430/60
5,965,311 A * 10/1999 Suzuki ..... 430/60
6,771,389 B1 8/2004 Sawayama
6,773,857 B2 * 8/2004 Nakamura et al. ..... 430/65
2003/0157421 A1 * 8/2003 Matsushima et al. ..... 430/124
2003/0186144 A1 10/2003 Kunieda
2005/0260511 A1 * 11/2005 Kunieda et al. ..... 430/58.8

FOREIGN PATENT DOCUMENTS

JP 04261547 A * 9/1992
JP 07128874 A * 5/1995
JP 2000105475 4/2000
JP 2001066799 3/2001
JP 2003084472 3/2003
JP 2003270808 9/2003
JP 2004177461 6/2004

OTHER PUBLICATIONS

English translation of JP-07128894.*
English translation of JP-2000267321.*

* cited by examiner

*Primary Examiner*—Christopher RoDee

(57) ABSTRACT

An organic photoreceptor, comprising a conductive support, an intermediate layer provided on the conductive support, having a thickness of 6 to 25 μm and containing inorganic particles having a number average primary particle diameter of 5 to 200 μm; and a photosensitive layer provided on the intermediate layer and having a thickness of 8 to 18 μm, wherein the thickness of the intermediate layer is larger than that of the photosensitive layer.

16 Claims, 3 Drawing Sheets

ORGANIC PHOTORECEPTOR, IMAGE FORMING APPARATUS, IMAGE FORMING METHOD AND PROCESS CARTRIDGE

BACKGROUND OF THE INVENTION

The present invention relates to an organic photoreceptor for use in an image formation of an electro-photographic method, an image forming apparatus employing the organic photoreceptor, an image forming method and a process cartridge and in more detail, to an organic photoreceptor for use in an image formation of an electro-photographic method usable in the field of a copying machine and a printer, an image forming apparatus employing the organic photoreceptor, an image forming method and a process cartridge.

The main subject of a photoreceptor is transferred from an inorganic photoreceptor such as Se, arsenic, arsenic/Se alloy, CdS, ZnO, to an organic photoreceptor which has advantages in the environmental pollution, or easiness of manufacturing, and the organic photoreceptors using various materials are developed.

Recently, the function separation type photoreceptor in which functions for generating the electronic charge and for charge transportation are made in charge to different materials, becomes the main stream, for example, a laminated type photoreceptor in which the charge generation layer, charge transporting layer are laminated through the intermediate layer on the conductive supporting body, is widely used (Patent Document 1).

On the other hand, even for a copying machine and a printer, there is a strong demand for digital color images having high image quality. For the demand of this kind, it has been proposed that a laser beam having a short wavelength is used as a light source for exposure, and thereby, a digital image of high density is formed (Patent Document 2). However, even when an electrostatic latent image is formed on an organic photoconductor by using a laser beam having a short wavelength, it is not always possible to form a microscopic dot latent image, and that dot latent image cannot be reproduced separately and at high density, and an individual dot image cannot be reproduced independently, or it disappears, thus, a minute electrophotographic image has not been attained sufficiently.

For reproducing a highly fine electrostatic latent image faithfully, potential contrast between an exposed portion and an unexposed portion needs to be secured sufficiently, and for that purpose, it is important to restrain diffusion of carrier during a period for carrier generated by image-wise exposure to arrive at charges on the surface of a photoconductor. With respect to deterioration of a latent image for a high density image, an effect of diffusion to an electrostatic latent image cannot be ignored when a ratio D/μ of a diffusion constant of a charge transport layer (D) to drift mobility (μ) grows greater, and it is reported that deterioration of a latent image grows greater when a film thickness of a charge transport layer is great. (Non-patent Document 1).

An electrophotographic photoconductor wherein diffusion of an electrostatic latent image is prevented by making a film of a charge transport layer to be thin, has already been proposed in the field of a patent. However, when an image is formed on the proposed organic photoconductor by the use of an electrophotographic image forming apparatus actually, a blurred image with lowered image density tends to appear. The reason for this is as follows; if a film of an electrophotographic photoconductor is made to be thin, capacitance of a photosensitive layer becomes smaller, charging potential tends to be lowered and sufficient image potential (a difference between the charging potential and residual potential) is hardly obtained, resulting in a decline of developability and a decline of image density. In particular, when using a developer employing small-sized toner particles for obtaining high image quality, developability is lowered, image density is not sufficient in reversal development, and it is difficult to obtain character images having excellent sharpness and photographic images, which is a problem.

For restoring the decline of developability, it is effective to give charges wherein an amount of charges per unit area is increased to the electrophotographic photoconductor with a thin film, and thereby, to increase electric field strength per unit film thickness of the photoconductor. However, when the electric field strength per unit film thickness of the photoconductor is increased, sensitivity shortage of the photoconductor is caused, residual potential tends to be increased in the course of repeated image forming operations, and a decline of image density and periodic image defects such as a black spot and white clearness tend to be caused.

(Patent Document 1) TOKUKAI No. 2004-133018

(Patent Document 2) TOKUKAIHEI No. 5-119503

(Non-patent Document 1) Page 296, No. 4 of Volume 38 in Journal of Imaging Society of Japan

SUMMARY OF THE INVENTION

According to the structure of the present invention, an organic photoreceptor, comprises:

a conductive support, an intermediate layer provided on the conductive support, having a thickness of 6 to 25 μm and containing inorganic particles having a number average primary particle diameter of 5 to 200 μm; and a photosensitive layer provided on the intermediate layer and having a thickness of 8 to 18 μm, wherein the thickness of the intermediate layer is larger than that of the photosensitive layer.

DETAILED DESCRIPTION OF THE PREFERRED EMBODIMENT

Figure 1:
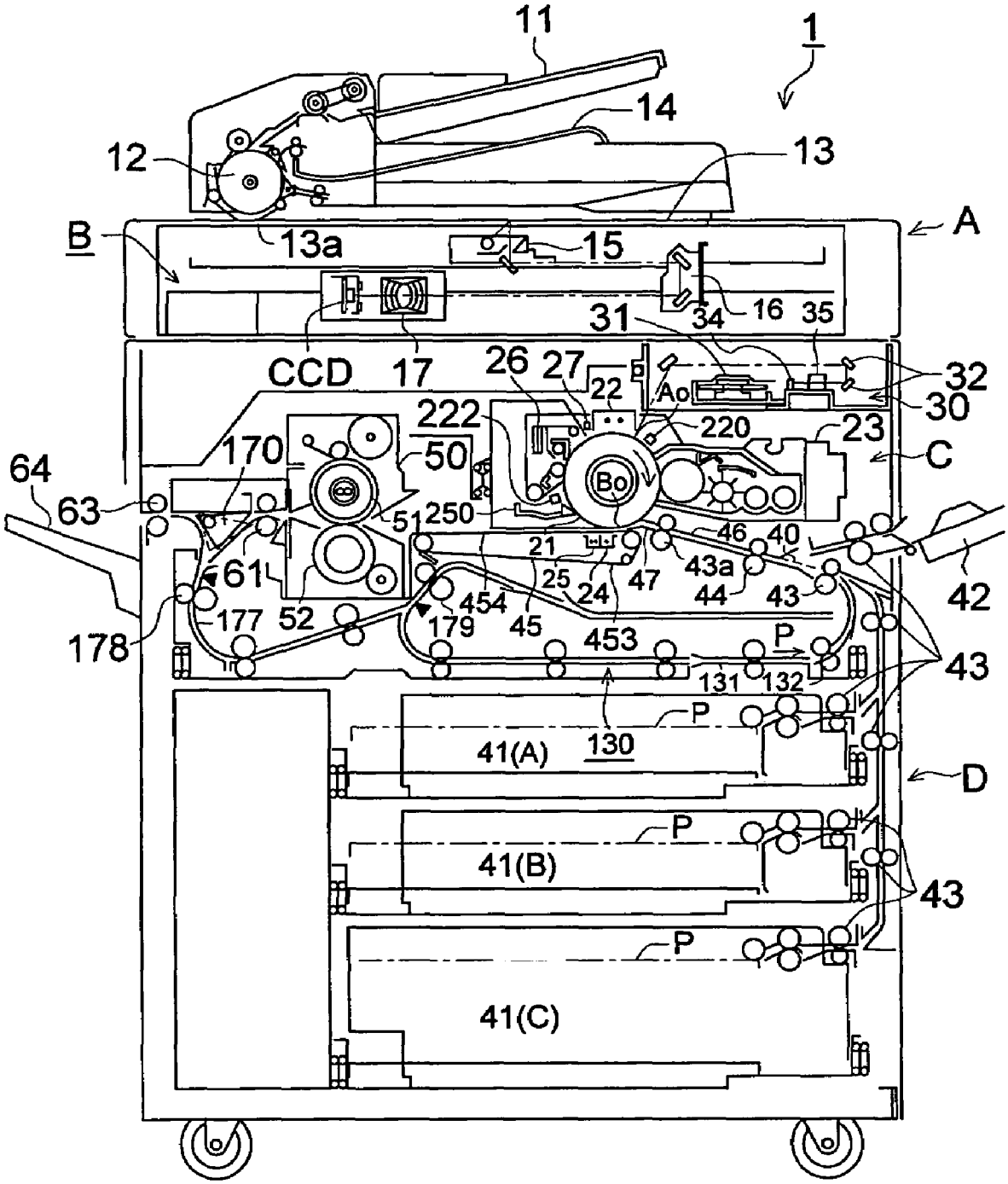
FIG. 1 is a sectional schematic view of an image forming apparatus relating to the invention.

In order to solve the aforesaid problems, the invention provides an organic photoconductor that can reproduce an electrostatic latent image formed on the organic photoconductor through an image-wise exposure light source such as a semiconductor laser or a light emitting diode, faithfully as a toner image, and provides an image forming apparatus, an image forming method and a process cartridge, wherein the aforesaid organic photoconductor is used, sufficient image density is attained, image defects such as a black spot and white clearness are not caused and sharpness is excellent. Further, the invention provides an organic photoconductor that can reproduce an electrostatic latent image formed on an organic photoconductor through an image-wise exposure light source such as a semiconductor laser having an emission wavelength of 350-500 nm or a light emitting diode, faithfully as a toner image.

As a result of the study by the inventor, in order to visualize faithfully an electrostatic latent image formed on an organic photoreceptor with an image exposure light source of a semiconductor or a light emitting diode into a toner image, the inventor found that the structure to provide a thin layer of a photosensitive layer on a thicker layer of an intermediate layer in the layer structure of an organic photoreceptor is effective.

Preferable structures according to the present invention will be explained in detail as follows.

An organic photoconductor of the invention is one that is used for an image forming apparatus having therein a charging means that gives uniform charges on an organic photoconductor, an exposure means that forms an electrostatic latent image on the organic photoconductor by using an image-wise exposure light source such as a semiconductor laser or a light emitting diode, and a developing means that develops the electrostatic latent image into a visible toner image, wherein the organic photoconductor has the structure in which an intermediate layer containing inorganic particles whose number-average primary particle size is 5-200 nm is laminated on a conductive support, and a photosensitive layer is laminated on the intermediate layer, and a layer thickness of the intermediate layer is larger than 6 μm and is not more than 25 μm, while, a layer thickness of the photosensitive layer is within a range of 8-18 μm.

An organic photoconductor of the invention has the aforesaid structure to be capable of visualizing a minute electrostatic latent image formed on an organic photoconductor faithfully for a long time by the use of an image-wise exposure light source such as a semiconductor laser or a light emitting diode with an emission wavelength of 350-500 nm, then, attaining sufficient image density and being free from image defects such as a black spot and white clearness to form an electrophotographic images with excellent sharpness.

An organic photoconductor used for the image forming method of the invention will be described. An organic photoconductor of the invention has the structure in which an intermediate layer containing inorganic particles whose number-average primary particle size is 5-200 nm is laminated on a conductive support, and a photosensitive layer is laminated on the intermediate layer, and a layer thickness of the intermediate layer is larger than 6 μm and is not more than 25 μm, while, a layer thickness of the photosensitive layer is within a range of 8-18 μm, and a layer thickness of the intermediate layer is greater than that of the photosensitive layer. More preferable is $1.1<A/B<3.0$ when Aμm represents a layer thickness of the intermediate layer and Bμm represents a layer thickness of the photosensitive layer. Still more preferable is $1.5<A/B<2.5$. By keeping this range, it is possible to obtain a high-definition image that satisfies simultaneously three factors of a defect-free image including reproducibility of a microscopic dot, so-called high reproducibility of sharpness and so-called high image quality of image density, photographic fog and a photographic image, and is free from defects such as a black spot and white clearness. The layer thickness of the photosensitive layer means CGL+CTL thickness.

Under the condition that the organic photoconductor has the aforesaid structure, when an electrophotographic image is made by the use of an image forming apparatus having an exposure means that forms an electrostatic latent image on the organic photoconductor by using an image-wise exposure light source such as a semiconductor laser or a light emitting diode with emission wavelength of 350-500 nm and a developing means that develops the electrostatic latent image into a visible toner image, a minute electrostatic latent image formed on an organic photoconductor can be visualized faithfully, sufficient image density can be attained, and an electrophotographic image that is free from image defects such as a black spot and white clearness and has excellent sharpness can be formed.

In the invention, an organic photoconductor means an electrophotographic photoconductor that is constructed by allowing an organic compound to have at least one of a charge generation function and a charge transport function which are essential for constituting the electrophotographic photoconductor, and it includes all of known organic photoconductors such as a photoconductor composed of a known organic charge generation substance or of an organic charge transport substance and a photoconductor wherein each of a charge generation function and a charge transport function is composed of a high molecular complex.

With respect to the structure of the photoconductor of the invention, preferable is one wherein a charge generation function and a charge transport function are laminated in succession on a conductive support as a photosensitive layer, through an intermediate layer. Further, in case of need, a surface protective layer may further be formed on the photosensitive layer.

Hereinafter, a preferable concrete example of a layer construction of an organic photoreceptor according to the invention will be described.

Conductive Supporting Member:

A cylindrical or sheet-shaped conductive supporting member may be used as the conductive supporting member usable for the photoreceptor of the invention.

The cylindrical conductive supporting member can be defined as a cylindrical support required to form images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive supporting member may include a metallic drum made of aluminum, nickel or the like, a plastic drum formed by vapor deposition of aluminum, tin oxide, indium oxide or the like, or a paper/plastic drum coated with conductive substance. The conductive supporting member is preferred to have a specific resistance of $10^3$ Ωcm or less at the normal temperature.

A conductive supporting member wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Intermediate Layer:

An intermediate layer according to the invention is a layer provided between a conductive supporting member and a photosensitive layer.

In the present invention, an intermediate layer is provided between a conductive supporting member and a photosensitive layer. In the intermediate layer, inorganic particles having a number average primary order particle diameters of 5-200 nm are contained.

As inorganic particles used for the intermediate layer according to the present invention, metal oxides, such as a titanium oxide (TiO2), a zinc oxide (ZnO), a tin oxide (SnO2), a zirconium oxide, a cerium oxide, an iron oxide, an aluminium oxide, a tungstic oxide, and a bismuth oxide, are used preferably, and further, metallic carbide, such as silicon carbide and titanium carbide, titanate such as strontium titanate, titanic acid calcium, and barium titanate, carbonate such as calcium carbonate, metal nitrides, such as aluminium nitride, and sulfate such as barium sulfate, copper sulfate, and zinc sulfate etc. may be used.

Among these inorganic particles, inorganic particles preferably used for the present invention may be N-type semiconductive particles desirably.

The N-type semiconductive fine particles means that main charge carriers are particles of electrons. That is, since main charge carriers are particles of electrons, the intermediate layer in which the N-type semiconductive fine particles are contained in the insulating binder, effectively blocks the hole injection from the conductive base support and has a property having a transporting capability for the electron from the photosensitive layer.

The N-type semiconductive particles include the particles of titanium oxide ($TiO_2$), zinc oxide (ZnO) and tin oxide ($SnO_2$), and the titanium oxide is preferable.

The number average primary particle diameter of the inorganic particles contained in the intermediate layer is preferably 5.0 nm to 200 nm, more preferably 15 to 100 nm may be used. If it is less than 5 nm, the inorganic particles tend to agglomerate in a binder, an evenness of the intermediate layer becomes insufficient, the electric potential characteristic of a photoreceptor tends to be unstable and fogging tends to occur. On the other hand, If it is more than 200 nm, an evenness of the intermediate layer becomes insufficient, and voids tend to take place in the intermediate layer, similarly, the electric potential characteristic of a photoreceptor tends to be unstable and fogging tends to occur.

The number average primary particle size of the inorganic particles described above is obtained by the following. For example, the fine particles are magnified by a factor of 10,000 with a transmission electron microscope, and one hundred particles are randomly selected as primary order particles from the magnified particles, and the number average primary particle size are obtained by measuring an average value of the FERE diameter according to image analysis.

These titanium oxide particles are an anatase type, a rutile type, a Brookite type and an amorphous type as its crystal type. Of these types, the rutile type titanium oxide pigment or the anatase type titanium oxide is particularly preferred since it enhances rectifying characteristics of charge through the intermediate layer, i.e., mobility of electron, whereby charge potential is stabilized and high density dot image can be formed as well as increase of residual potential is prohibited.

The inorganic particles preferably has been subjected to a surface treatment with a polymer containing methylhydrogensiloxane unit. The number average molecular weight of the polymer containing the methylhydrogensiloxane unit may be preferably 1,000 to 20,000, because a polymer having such the molecular weight has a high surface treatment effect. As a result, it enhances rectifying characteristics of inorganic particles. By using an intermediate layer containing these inorganic particles, the occurrence of black spots is prevented and it provides an effect for producing a high density dot image.

The polymer containing a methylhydrogensiloxane unit is preferably a copolymer of a structural unit of —($HSi(CH_3)O$)— and another siloxane unit. Preferable another siloxane unit is a dimethylsiloxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a block copolymer and a graft copolymer are usable. A copolymerizing composition other than the methylhydrogensiloxane may be one or more compositions.

The inorganic particles may be one subjected to surface treatment by a reactive organic Silicon compound represented by the following formula.

$$(R)_n—Si—(X)_{4-n}$$

In the above, Si is a silicon atom, R is an organic group directly bonded by the carbon atom thereof to the silicone atom, X is a hydrolyzable group and n is an integer of 0 to 3.

In the organic silicone compound represented by the above formula, the organic group represented by R which is directly bonded by the carbon atom thereof to the silicone atom is, for example, an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl) ethyl group; a (metha)acryloyl group-containing group such as a γ-acryloxypropyl group and a γ-methacryloxypropyl group; a hydroxyl group-containing group such as a γ-hydroxypropyl group and a 2,3-dihydroxypropyloxypropyl group, a vinyl group-containing group such as a vinyl group and a propenyl group; a mercapto group-containing group such as a γ-mercaptopropyl group: an amino group-containing such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluoroctylethyl group; and a nitro group and a cyano-substituted alkyl group. Examples of the hydrolyzable group include an alkoxy group such as a methoxy group and an ethoxy group; a halogen atom and an acyloxy group.

The organic silicone compound represented by the foregoing may be employed singly or in combination of two or more kinds thereof.

In the compounds represented by the foregoing organic silicone compound, plural groups represented by R may be the same or different when n is 2 or more. Also, plural groups represented by X may be the same or different when n is 2 or less. Further, when two kinds or more of the organic silicone compound, R and X may be the same or different among respective compositions.

The inorganic particles may be subjected to a surface treatment by alumina or silica before the surface treatment by the methylhydrogensiloxane copolymer or the reactive organic silicone compound.

Before the surface treatment for N-type semiconductive particles, a surface treatment with at least one kind selected from alumina, silica or zirconia may be conducted.

Here, the alumina treatment, the silica treatment or the zirconia treatment means a treatment to deposit alumina, silica or zirconia on the surface of the anatase type titanium oxide, and the alumina, silica or zirconia deposited on the surface includes a hydrate of alumina, silica or zirconia.

The treatment by alumina and that by silica may be performed simultaneously, and it is particularly preferable that the treatment by alumina is firstly carried out and then the treatment by silica is provided. The amount of silica is preferably larger than that of alumina when the treatments by alumina and silica are applied.

An intermediate layer coating liquid prepared for forming the intermediate layer employed in the invention is constituted by a binder and a dispersing solvent additional to the surface-treated N-type semiconductor particles.

The ratio of the inorganic particles in the intermediate layer is preferably from 1.0 to 2.0 times of the binder resin of the intermediate layer in the volume ratio (when the volume of the binder resin is assumed as 1). By employing the inorganic particles in such the high density in the intermediate layer, a rectifying ability of the intermediate layer is increased so that the increasing of the remaining potential and the transfer memory are not caused even when the thickness of the layer is increased, the black spots can be effectively prevented and the suitable organic photoreceptor with small potential fluctuation can be prepared.

As the binder for dispersing the particles and forming the intermediate layer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the intermediate layer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4%.

The heat of fusion of the resin is measured by differential scanning calorimetry (DSC). Another method may be utilized as long as a result the same as that obtained by DSC can be obtained. The heat of fusion is obtained from the area of endothermic peak in the course of temperature rising in the DSC measurement.

The water absorption degree of the resin is measured by the weight variation by a water immersion method or Karl-Fischer's method.

As the binder resin of the intermediate layer, a resin superior in the solubility in solvent is necessary for forming the intermediate layer having a uniform layer thickness. Alcohol-soluble polyamide resins are preferable for the binder resin of the intermediate layer. As such the alcohol-soluble polyamide resin, copolymerized polyamide resins having a short carbon chain between the amide bond such as 6-Nylon and methoxymethylized polyamide resins have been known. These resins have high water absorption degree, and the intermediate layer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g and a water absorption degree of not more than 5% by weight are employed to improve such the shortcoming of the usual alcohol-soluble polyamide resin. Thus good electrophotographic image can be obtained even when the exterior environmental conditions are changed and the electrophotographic photoreceptor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole % of the entire repeating units.

Here, the repeating unit structure of the carbon atoms number of 7 to 30 between the amide bonding is explained. The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 5, in which the number of carbon atoms included in X is the carbon number of the amide bond unit in the repeating unit. The repeating unit structure of Type B is represented by Formula 6, in which both of the number of carbon atoms included in Y and that included in Z are each the number of carbon atoms of the amide bond in the repeating unit structure.

Formula 2

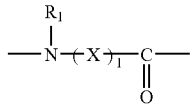

In Formula (2), $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 3

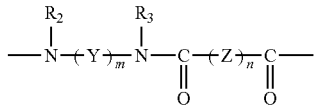

In the formula (3), $R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30. The carbon number is preferably from 9 to 25, more preferably from 11 to 20. The ratio of the structural repeating unit having a carbon atom number from 7 to 0.30 between the amide bonds to the entire repeating units is from 40 to 100 mole-percent, preferably from 60 to 100 mole-percent, and further preferably from 80 to 100 mole-percent.

When the number of the carbon atoms is less than 7, the hygroscopic property of the polyamide resin becomes large, the photographic properties, particularly the humidity dependency of the potential on the occasion of the repeating use is made large and the image defects such as the black spots tends to occur, and the reproducibility of a dot image becomes deteriorated. When the number of the carbon atoms is larger than 30, the solubility of the resin in the solvent for coating becomes bad and it becomes improper for forming a coating layer of an intermediate layer.

When the ratio of the structural repeating unit having a carbon atom number from 7 to 30 between the amide bonds to the entire repeating units is Number of carbon atoms of polyamide is smaller than 40 mol-percent, the above effect becomes small.

Polyamide resins having a repeating unit structure represented by Formula 4 are preferred.

Formula 4

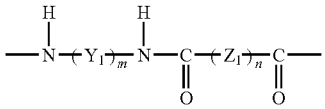

In the above formula (4), $Y_1$ is a di-valent group containing an alkyl-substituted cycloalkane group, $Z_1$ is a methylene group, m is an integer of from 1 to 3 and n is an integer of 3 to 20.

In the above formula (4), the polyamide resins in which the group represented by $Y_1$ is the group represented by the following formula are preferable since such the polyamide resins display considerable improving effect on the black spot occurrence.

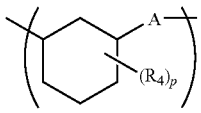

In the above, A is a simple bond or an alkylene group having from 1 to 4 carbon atoms; $R_4$ is an alkyl group; and p is a natural number from 1 to 5. Plural $R_4$ may be the same as or different from each other.

Concrete examples of the polyamide resin are shown below.

N-1

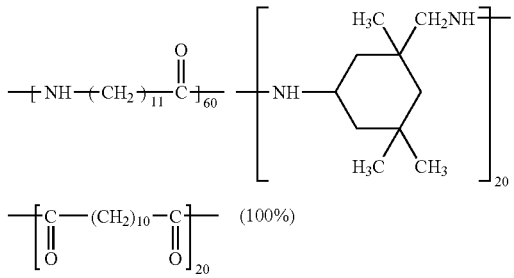

N-2

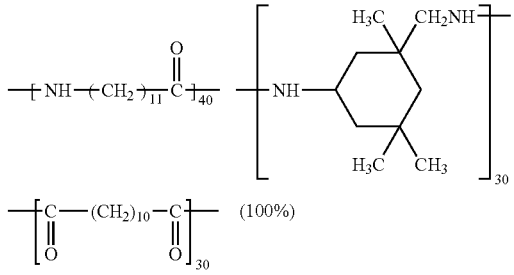

N-3

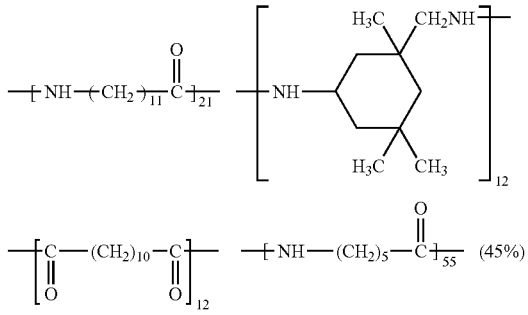

N-4

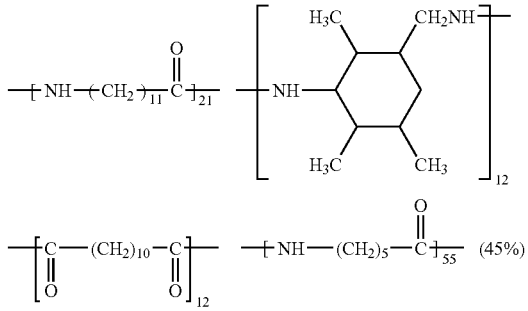

N-5

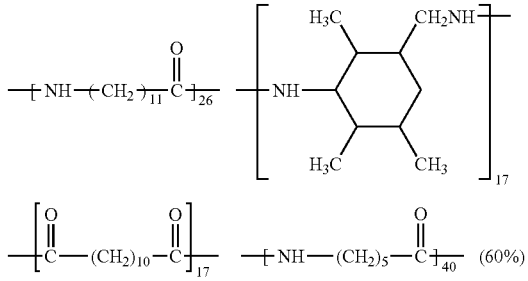

-continued

N-6

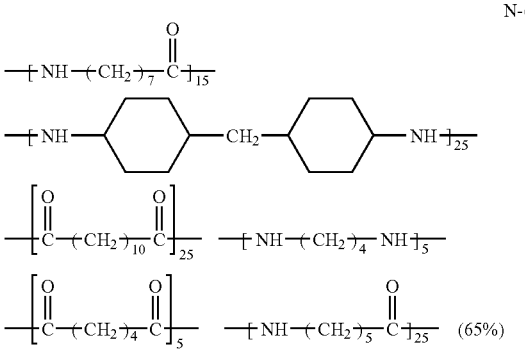

N-7

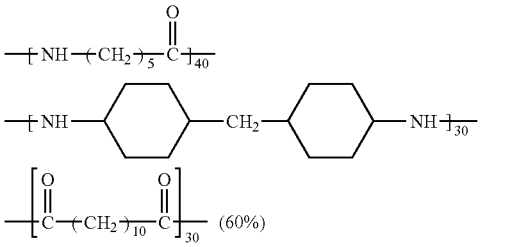

N-8

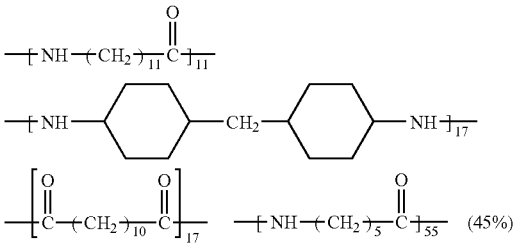

N-9

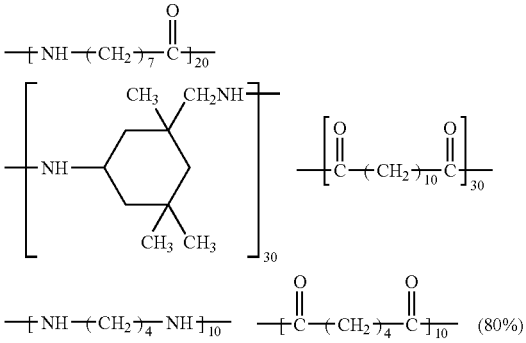

N-10

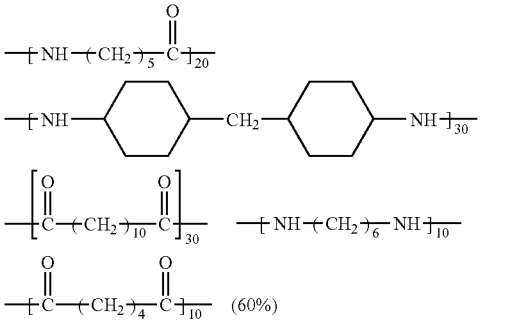

N-11

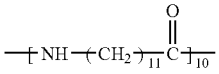

-continued

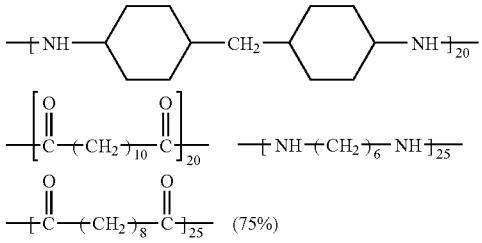

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 4 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the intermediate layer and the occurrence of the image defects such as the black spots are inhibited.

The polyamide resin, for example, VESTAMELT X1010 and X4685, manufactured by Daicel•Degussa Ltd., are available in the market, and it is easy to prepare in a usual method. An example of the synthesis method is described.

Synthesis of Exemplified Polyamide Resin (N-1)

In a polymerization vessel equipped with a stirring machine, nitrogen, a nitrogen introduction pipe, a thermometer, a desiccation pipe, etc., 215 mass parts of lauryl lactam and 112 mass parts of 3-amino methyl-3, 5, and 5-trimethyl cyclohexylamine, 1, 153 mass parts of 12-dodecane dicarboxylic acid, and 2 mass parts of a water are mixed, and were made to react under heating pressurization for 9 hours, while making water distill. When the polymerized product was taken out and the copolymerization composition of it was searched by $C^{13}$-NMR, it was in agreement with composition of N-1. Incidentally, the melt flow index (MFI) of the copolymerization synthesized above was 5 g/10 min under the condition of (230 degrees C./2.16 kg).

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

The intermediate layer is substantially an insulation layer. The volume resistivity of the insulation layer is not less than $1\times10^{8}$ Ω·cm. The volume resistivity of the intermediate layer and the protective layer is preferably from $1\times10^{8}$ to $1\times10^{15}$ Ω·cm, more preferably from $1\times10^{9}$ to $1\times10^{14}$ Ω·cm, and further preferably from $2\times10^{9}$ to $1\times10^{13}$ Ω·cm. The volume resistivity can be measured as follows.

Measuring condition: According to JIS C2318-1975

Measuring apparatus: Hiresta IP manufactured by Mitsubishi Chemical Corporation.

Measuring condition: Measuring prove HRS

Applied voltage: 500 V

Measuring environment: 30±2° C., 80±5% RH

When volume resistance becomes less than $1\times10^{8}$, an intermediate layer's electric charge blocking tendency falls, generation of a black spot increases, the potential holdout of an organic photoreceptor also deteriorates, and excellent image quality may be not acquired. On the other hand, when it becomes larger than $10^{15}$ Ω·cm, a residual potential on a repeating image formation will tend to increase, and an excellent image quality will not be acquired.

It may be preferable to set the thickness of the intermediate layer to be within a range of 6 μm or more and 25 μm or less, more preferably within a range of 7 to 20 μm. When the thickness of the intermediate layer is too thin, the prevention for cracking is insufficient, in contrast, when the thickness of the intermediate layer exceeds 25 μm, the smoothness of the layer surface may be loosed, the sensitivity of the photoreceptor become lower, the residual voltage increases, and fogging and density lowering may occur.

Photosensitive Layer

The photosensitive layer preferably has a structure in which the functions of the photosensitive layer are separated into a charge generation layer (CGL) and a charge transfer layer (CTL) provided on the intermediate layer, even though the photosensitive layer constituted by a single layer structure having both of the charge generation function and the charge transfer function may be applied. By the function separated structure, the increasing of the remaining potential accompanied with repeating use can be inhibited and the other electrophotographic properties can be easily controlled for fitting to the purpose. In the negatively charging photoreceptor, the structure in which the charge generation layer (CGL) is provided on the intermediate layer, and the charge transfer layer (CTL) is further provided on the charge generation layer. In the photoreceptor to be positively charged, the order of the CGL and CTL in the negatively charged photoreceptor is revered. The most preferable structure of a photoreceptor according to the e present invention is a negatively chargeable photoreceptor having a function separated structure. Incidentally, although a structure which laminates a surface protecting layer on a charge transporting layer is desirable, the surface protecting layer is also added to the layer thickness of the photosensitive layer according to the present invention when the surface protecting layer has an electric charge transporting function.

The structure of the photosensitive layer of the negatively chargeable function-separated photoreceptor is described below.

Charge Generating Layer

It is desirable for the organic photoreceptor according to the present invention to use an electric charge generating substance which has high sensitiveness characteristics to a wave length region of 350 nm-500 nm as an electric charge generating substance. As such an electric charge generating substance, an azo pigment, a perylene pigment, a sensitive quinone pigment, etc. are used preferably.

CGM-1

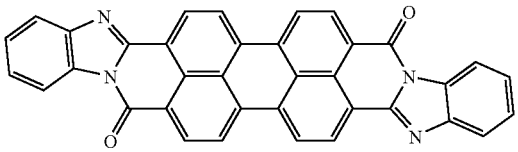

(1)

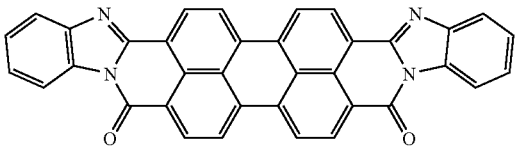

(2)

Mixture of (1) and (2)

CGM-2

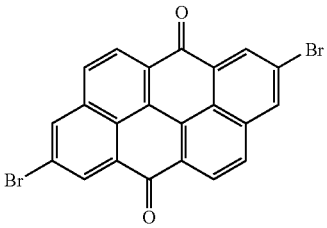

CGM-3

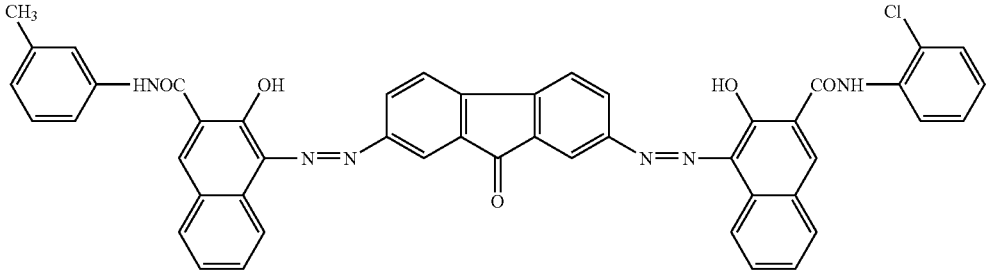

-continued

CGM-4

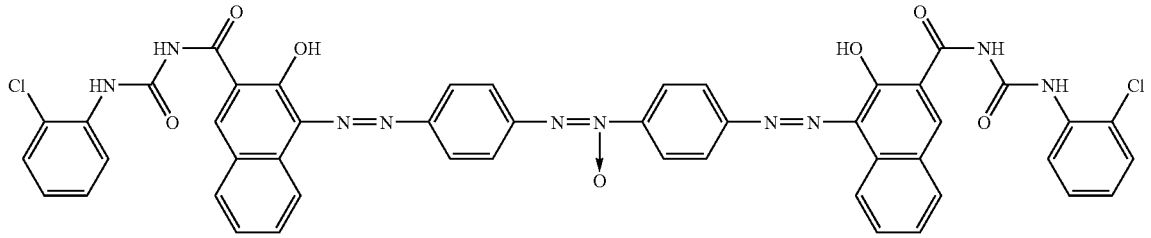

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight parts. Increase in residual electric potential with repeated use can be minimized by using these resins. The layer thickness of the charge generating layer is preferably in the range of 0.3 to 2 mm.

Charge Transporting Layer

As described above, the structure which constitutes the charge transporting layer from plural charge transporting layers and make a charge transporting layer of the top layer contain fluorine based resin particles is preferable.

A charge transporting layer contains a charge transporting material (CTM) and a binder resin for dispersing the CTM and forming a layer. In addition to the fluorine based resin particles, the charge transporting layer may contain additives such as an antioxidant agent if necessary.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

CTM-1

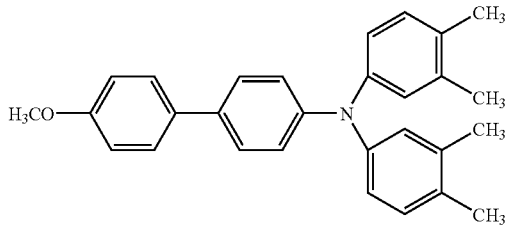

CTM-2

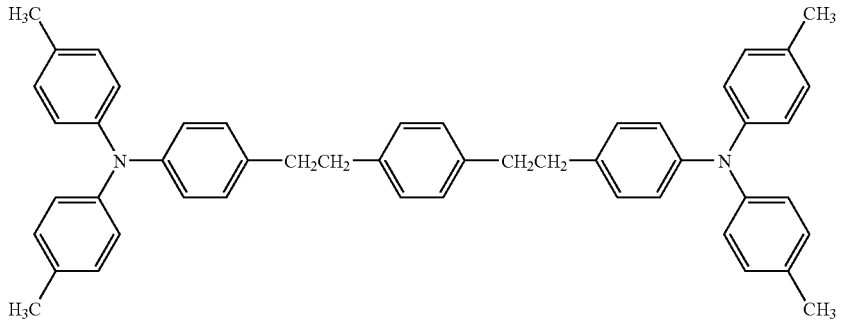

CTM-3

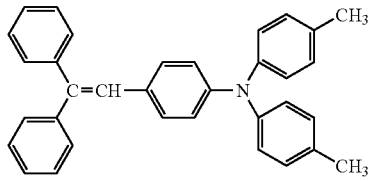

CTM-4

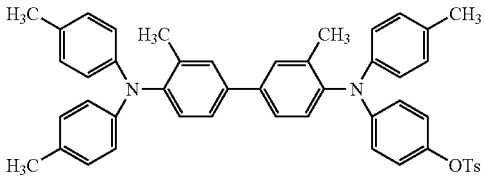

-continued

CTM-5

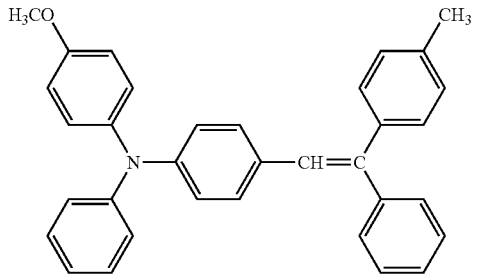

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resins, high polymer organic semiconductor such as poly —N— vinyl carbazole may be usable. The most preferred material is polycarbonate resin in view of, smaller water absorbing rate, dispersing ability of the CTM and electro photosensitive characteristics.

Ratio of the charge transporting material to the binder resin is preferably 50 to 200 parts by mass of charge transporting material to 100 parts by mass of the binder resin. Although the thickness of a photosensitive layer (total thickness of a charge generating layer and a charge transporting layer) of an organic photoreceptor according to the present invention is preferably 8 to 18 μm, the thickness of the charge transporting layer is preferably 8 μm or more and less than 18 μm, more preferably 10 to 17 μm. If the layer thickness exceeds 18 μm, dispersion of electric charge carrier becomes large in the charge transporting layer, then lowering of the sharpness and increasing of a residual voltage tends to take place.

Moreover, it is preferable to make the charge transporting layer contain an antioxidant. Although the surface layer of the photoreceptor tends to oxidize with activated gas at the time of charging, for example, NOx, ozone, etc., and easily generates a blur image, the occurrence of the blur image can be prevented by making an antioxidant exist together with it. The antioxidant is a material, as a typical one, having a character to prevent or control an action of oxygen under conditions, such as light, heat, and electric discharge, to an auto-oxidizing substance which exists in an organic photoconductor or on the surface of an organic photoconductor. Typically, the following compound groups are listed.

1-1

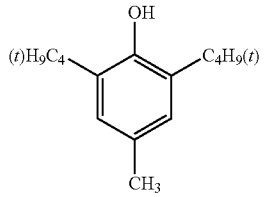

1-2

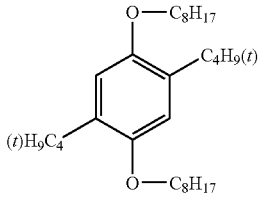

1-3

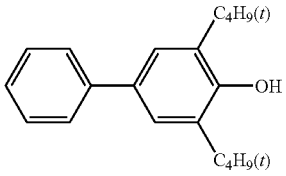

1-4

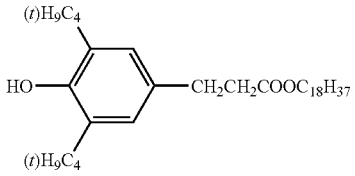

1-5

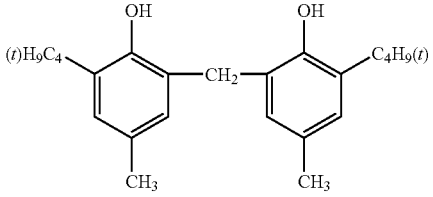

1-6

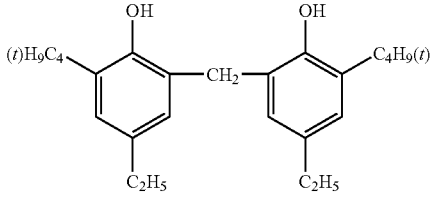

-continued
1-7
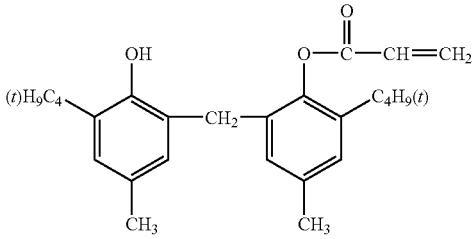
1-8
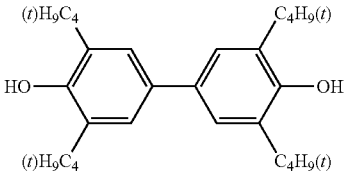
1-9
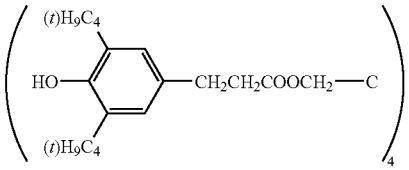
1-10
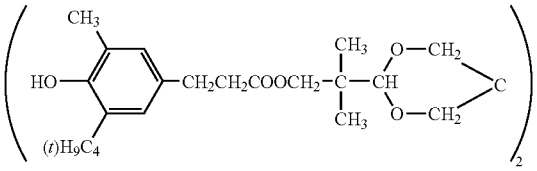
1-11
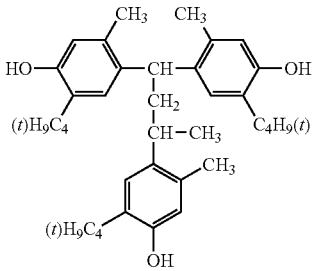
2-1
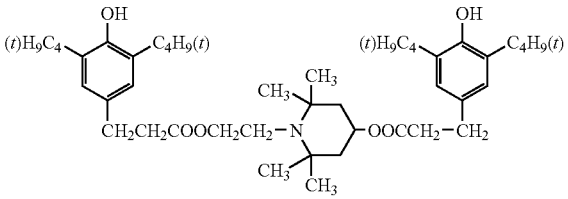
2-2
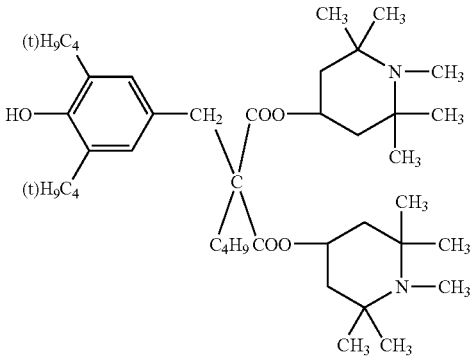
2-3
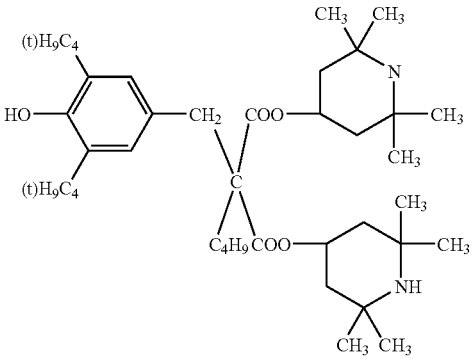
2-4
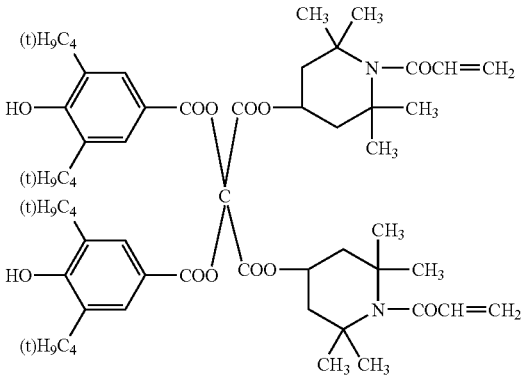
2-5
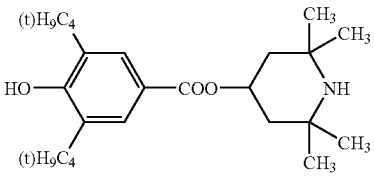

-continued 2-6

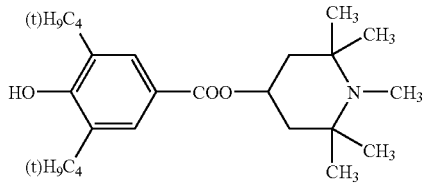

2-7

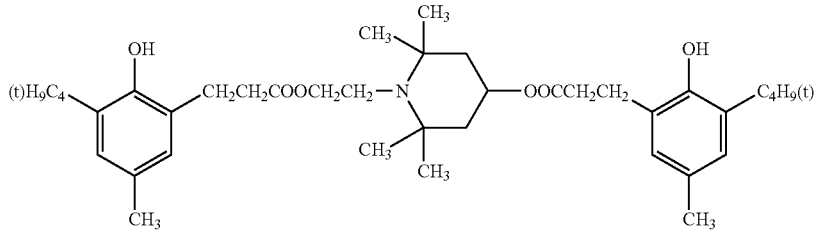

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

By using jointly the organic photoconductor and the developing means employing toner having sharp particle size distribution described below, the image forming apparatus of the invention makes it possible to prevent occurrence of image unevenness and an image blur caused by dash marks or abrasions, and to reproduce a highly fine dot latent image formed by a semiconductor laser having an emission wavelength of 350-500 nm or by a light emitting diode faithfully as a toner image, thus, excellent electrophotographic images can be made.

With respect to toner of the invention, it is preferable to contain toner wherein the number of toner particles whose particle size is 0.7×(Dp50) or less is 10 number % or less when Dp50 represents a particle size of 50% number of toner particles.

Toner of the invention is characterized to contain toner wherein a ratio (Dv50/Dp50) of 50% volume particle size (Dv50) to 50% number particle size (Dp50) for toner particles is 1.0-1.15, a ratio (Dv75/Dp75) of accumulation from largest volume particle size 75% volume particle size (Dv75) to accumulation from largest number particle size 75% number particle size (Dp75) is 1.0-1.20, and the number of toner particles whose particle size is 0.7×(Dp50) or less is 10 number % or less.

Namely, in the invention, it is possible to restrain simultaneously occurrence of image unevenness and an image blur caused by dash marks or abrasions, and to provide an image forming apparatus capable of forming excellent electrophotographic images, by using jointly the aforesaid photoconductor of the invention and the developing means employing toner having the particle size distribution described above.

Namely, with respect to toner used for the invention, it is preferable that the particle size distribution of the toner is of monodispersed one or of the dispersion close to the monodispersed one, and it is possible to provide an image forming apparatus capable of forming excellent electrophotographic images having excellent reproducibility of dot images.

If toner wherein the number of toner particles whose particle size is 0.7×(Dp50) or less is greater than 10 number % is used when Dp50 represents a particle size of 50% number of toner particles, it causes an increase of weak charging components, an occurrence of toner having opposite polarity, or an occurrence of over charging components, resulting in occurrence of photographic fog and reproducibility of dot images which tends to be deteriorated.

Further, as toner of the invention, it is more preferable that a ratio (Dv50/Dp50) of 50% volume particle size (Dv50) to 50% number particle size (Dp50) is 1.0-1.15, and a ratio (Dv75/Dp75) of accumulation from largest volume particle size 75% volume particle size (Dv75) to accumulation from largest number particle size 75% number particle size (Dp75) is 1.0-1.20, in addition to the condition that the number of toner particles of the 0.7×(Dp50) or less is 10 number % or less.

Incidentally, it is preferable that the aforesaid 50% volume particle size (Dv50) is 3.0-7.5 μm rather than 3 0-9.5 μm. By keeping this range, the resolution can be enhanced.

The cumulative 75 percent volume particle diameter (Dv75) or the cumulative 75 percent number particle diameter (Dp75), as described herein, refers to the volume particle diameter or the number particle diameter, each of which is 75 percent with respect to the sum of the total volume or the sum of the total number while accumulating the frequency from the largest particle diameter.

In the invention, for 50% volume particle size (Dv50), 50% number particle size (Dp50), accumulation 75% volume particle size (Dv75) and accumulation 75% number particle size (Dp75), an apparatus wherein a computer system for data processing (made by Beckman Coulter Co.) is connected with Coulter Multisizer III (made by Beckman Coulter Co.) is used for measurement and computation.

As measurement procedures, after toner weighing 0.02 g is made to adapt itself to 20 ml of surfactant solution (a surfactant solution obtained by diluting a neutral detergent containing, for example, surfactant components, with pure water by a factor of ten, for the purpose of homogenization of toner), ultrasonic homogenization is conducted for one minute to prepare a toner-dispersed solution. This toner-dispersed solution is poured into a beaker containing ISOTON II (made by Beckman Coulter Co.) with a pipette until the measured concentration comes to 5%-10%, and a count on a measuring instrument is set to 2500 pieces for measurement. Incidentally, an aperture diameter measuring 50 μm was used.

In the technical field in which electrostatic latent images are visualized employing dry system development, as an electrostatic image developing toner employed are those which are prepared by adding external additives to colored particles containing at least colorants and resins. However, as long as specifically there occur no problems, it is generally described that colored particles are not differentiated from the electrostatic latent image developing toner. The particle diameter and particle size distribution of the colored particles result in the same measurement values as the electrostatic latent image developing toner.

The particle diameter of external agents is in an order of nm in terms of the number average primary particle. It is possible to determine the diameter employing an Electrophoretic Light Scattering Spectrophotometer "ELS-800" (manufactured by Otsuka Electronics Co., Ltd.).

The structure as well as the production method of the toner will now be described.

<Toner>

Toner which may be prepared by pulverization method or polymerization method can be employed. Polymerization toner is preferably employed because toner having uniform particle size distribution is stably obtained.

The polymerization toner is prepared by polymerization of binder resin of toner from monomers, and if necessary, subsequent chemical process. Practically it includes polymerization process such as suspension polymerization and emulsion polymerization, and fusion process of particles conducted thereafter if necessary.

It is preferable that a coalesced type toner is employed, which is prepared by salting out and fusing resin particles comprising release agents and colorant particles.

As the reason for such toner, it is assumed that since it is possible to easily control the particle size distribution of the coalesced type toner and it is possible to prepare toner particles which exhibit uniform surface properties of each particle, the effects of the present invention are exhibited without degrading transferability.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resin particles and colorant particles) at temperatures higher than or equal to the glass transition temperature (Tg) of resins constituting the resin particles.

Releasing Agent

Although the releasing agent usable for the present invention is not limited to a specific one, a preferable releasing agent is one containing a crystalline ester compound represented by the general formula (5), herein after referred as "specific ester compound".

$$R_1\text{-}(OCO\text{—}R_2)_n \qquad \text{General formula (5)}$$

In the formula n is an integer from 1 to 4, preferably from 2 to 4, and more preferably 3 or 4. $R_1$ and $R_2$ each represents a hydrocarbon group which has a carbon number of 1-40 and may have a substituent.

<Specific Ester Compound>

In the general formula representing the specific ester compound, $R_1$ and $R_2$ each represents a hydrocarbon group which may have a substituent.

The number of carbon atoms in $R^1$ is from 1 to 40, preferably from 1 to 20, and more preferably from 2 to 5.

The number of carbon atoms in $R^2$ is from 1 to 40, preferably from 16 to 30, and more preferably from 18 to 26.

In the formula n is an integer from 1 to 4, preferably from 2 to 4, more preferably 3 or 4 and particularly 4.

The compound is synthesized by a dehydration condensation reaction of an alcohol compound and a carbonic acid adequately.

Most preferable example of the compound is pentaerythritoltetrabehanate.

Representative examples are listed as compounds 1 to 26.

1)
$$CH_3\text{—}(CH_2)_{12}\text{—}COO\text{—}(CH_2)_{17}\text{—}CH_3$$

2)
$$CH_3\text{—}(CH_2)_{18}\text{—}COO\text{—}(CH_2)_{17}\text{—}CH_3$$

3)
$$CH_3\text{—}(CH_2)_{20}\text{—}COO\text{—}(CH_2)_{21}\text{—}CH_3$$

4)
$$CH_3\text{—}(CH_2)_{14}\text{—}COO\text{—}(CH_2)_{19}\text{—}CH_3$$

5)
$$CH_3\text{—}(CH_2)_{20}\text{—}COO\text{—}(CH_2)_6\text{—}O\text{—}CO\text{—}(CH_2)_{20}\text{—}CH_3$$

6)
$$CH_3\text{—}(CH_2)_{20}\text{—}COO\text{—}(CH_2)_2\text{—}\overset{\overset{CH_3}{|}}{CH}\text{—}CH_2\text{—}O\text{—}CO\text{—}(CH_2)_{20}\text{—}CH_3$$

7)
$$CH_3\text{—}(CH_2)_{22}\text{—}COO\text{—}(CH_2)_2\text{—}\overset{\overset{CH_3}{|}}{CH}\text{—}CH_2\text{—}O\text{—}CO\text{—}(CH_2)_{22}\text{—}CH_3$$

8)
$$CH_3\text{—}(CH_2)_{22}\text{—}COO\text{—}CH_2\text{—}\underset{\underset{CH_3}{|}}{\overset{\overset{CH_3}{|}}{C}}\text{—}CH_2\text{—}O\text{—}CO\text{—}(CH_2)_{22}\text{—}CH_3$$

9)
$$CH_3\text{—}(CH_2)_{26}\text{—}COO\text{—}CH_2\text{—}\underset{\underset{CH_3}{|}}{\overset{\overset{CH_3}{|}}{C}}\text{—}CH_2\text{—}O\text{—}CO\text{—}(CH_2)_{26}\text{—}CH_3$$

10)
$$\begin{array}{l} CH_2\text{—}O\text{—}CO\text{—}(CH_2)_{26}\text{—}CH_3 \\ | \\ CH\text{—}O\text{—}CO\text{—}(CH_2)_{26}\text{—}CH_3 \\ | \\ CH_2\text{—}O\text{—}CO\text{—}(CH_2)_{26}\text{—}CH_3 \end{array}$$

11)
$$\begin{array}{l} CH_2\text{—}O\text{—}CO\text{—}(CH_2)_{22}\text{—}CH_3 \\ | \\ CH\text{—}O\text{—}CO\text{—}(CH_2)_{22}\text{—}CH_3 \\ | \\ CH_2\text{—}O\text{—}CO\text{—}(CH_2)_{22}\text{—}CH_3 \end{array}$$

12)
$$\begin{array}{l} CH_2\text{—}OH \\ | \\ CH\text{—}O\text{—}CO\text{—}(CH_2)_{26}\text{—}CH_3 \\ | \\ CH_2\text{—}O\text{—}CO\text{—}(CH_2)_{26}\text{—}CH_3 \end{array}$$

-continued

13)

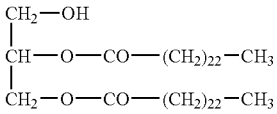

14)

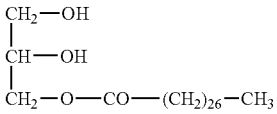

15)

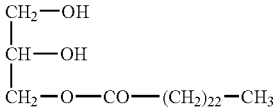

16)

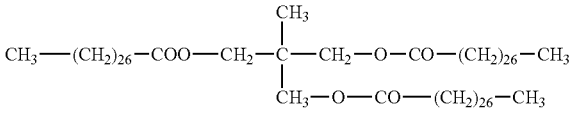

17)

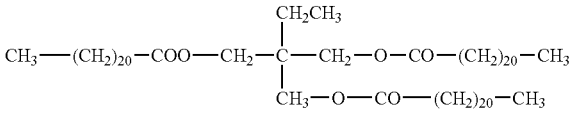

18)

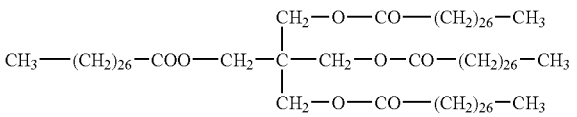

19)

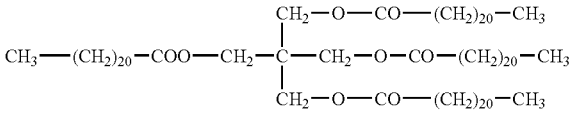

20)

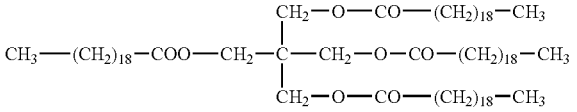

21)

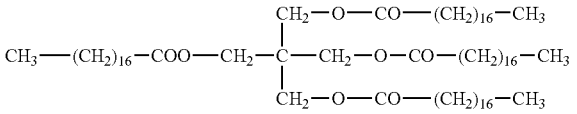

22)

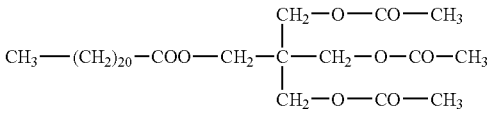

<Content of the Releasing Agent>

The content ratio of the releasing agent in the toner is commonly from 1 to 30 percent by weight, is preferably from 2 to 22 percent by weight, and is particularly preferably from 3 to 15 percent by weight.

<Resin Particles Comprising Releasing Agents>

"Resin particles containing releasing agents" may be obtained as latex particles by dissolving releasing agents in monomers to obtain binding resins, and then dispersing the resulting monomer solution into water based medium, and subsequently polymerizing the resulting dispersion.

Weight average particle size of the latex particles is preferably 50-2000 nm.

Listed as polymerization method employed to obtain resin particles, in which binding resins comprise releasing agents, may be granulation polymerization methods such as an emulsion polymerization method, a suspension polymerization method, a seed polymerization method, and the like.

The following method (hereinafter referred to as a "mini-emulsion method") may be cited as a preferable polymerization method to obtain resin particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which results in oil droplets in water dispersion, utilizing mechanical force, are not particularly limited, and may include "CLEARMIX" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

<Binder Resins>

Binder resins, which constitute the toner of the present invention, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

Material and preparation process of resin particles are described.

Monomer Material

Radical polymerizable monomer is necessary component, and crosslinking agent may be employed when necessary as the polymerizable monomer. It is preferred to contain at least one of the following radical polymerizable monomer having acid group or base group.

(1) Radical Polymerizable Monomer

Radical polymerizable monomer is employed without restriction. One, two or more monomers are employed in combination so as to satisfy the required characteristics.

Practically, aromatic vinyl monomer, (meta)acrylate monomer, vinyl ester monomer, vinyl ether monomer, monoolefin monomer, diolefin monomer, halogenated olefin monomer etc. are exemplified.

Examples of the aromatic vinyl monomer are styrene or styrene derivatives such as styrene, o-methylstyrene, m-methylstyrene, p-methylstyrene, p-methoxylstyrene, p-phenylstyrene, p-chlorostyrene, p-ethylstyrene, p-n-butylstyrene, p-t-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene.

Examples of the (meta)acrylic acid ester are methylacrylate, ethylacrylate, butylacrylate, 2-ethylhexylacrylate, cyclohexylacrylate, phenylacrylate, methylmethacrylate, ethylmethacrylate, butylmethacrylate, 2-ethylhexylmetaacrylate, β-hydroxymethacrylate, γ-aminopropylacrylate, stearylmethacrylate, dimethylaminoethyl methacrylate, and diethylaminoethyl methacrylate.

Examples of the vinyl ester monomer are vinyl acetate, vinyl propionate and vinyl benzoate.

Examples of the vinyl ether monomer are vinyl methyl ether, vinyl ethyl ether, vinyl isobutyl ether and vinyl phenyl ether.

Examples of the monoolefin monomer are ethylene, propylene, isobutylene, 1-butene, and 1-pentene, 4-methyl-1-pentene.

Examples of the diolefin monomer are butadiene, isoprene, and chloroprene.

Examples of the halogenated olefin monomer are vinyl chloride, vinylidene chloride, vinyl bromide.

(2) Crosslinking Agent

Radical polymerizable crosslinking agent can be added so as to improve toner characteristics. Examples of the radical polymerizable crosslinking agent are those having two or more unsaturated bonds such as divinylbenzene, divinylnaphthalene, divinylether, diethyleneglycol methacrylate, ethyleneglycol dimethacrylate, polyethyleneglycol dimethacrylate and diallyl phthalate.

(3) Radical Polymerizable Monomer Having Acid Group or Base Group

Examples of the radical polymerizable monomer having acid group or base group are carboxyl group containing monomer, sulfonic acid containing monomer, and amine compound such as primary amine, secondary amine, tertiary amine, quaternary amine.

Examples of the carboxyl group containing monomer are acrylic acid, methacrylic acid, fumaric acid, maleic acid, itaconic acid, cinnamic acid, maleic monobutylate, maleic monooctylate.

Examples of the sulfonic acid group containing monomer are styrenesulfonic acid, allylsulfosuccinic acid, octyl allylsulfosuccinate.

These may be in the form of alkali metal salt such as sodium and potassium, or alkali earth metal salt such as calcium.

Examples of the radical polymerization monomer containing base is listed as amine compounds, specifically, dimethylaminoethylacrylate, dimethylaminoethylmetacrylate, diethylaminoethylacrylate, diethylaminoethylmetacrylate, and quaternary ammonium slat of the above four compounds, 3-dimethylaminophenylacrylate, 2-hydroxy-3-methacryloxy propyl trimethylammonium salt, acrylamide, N-butylacrylamide, N,N-dibutyl acrylamide, piperidyl acrylamide, metacrylamide, N-butylmetacrylamide, N-octadecyl acrylamide; vinyl N-methylpyridinium chloride, vinyl N-ethyl pyridinium chloride, N,N-diallyl methylammonium chloride and N,N-diallyl ethylammonium chloride.

As for the amount of the radical polymerization monomer, radical polymerizable monomer containing acid group or base group is 0.1 to 15 weight % with reference to the total amount of the monomers. The amount of the radical polymerization crosslinking agent, which varies depending on its property, is 0.1 to 10 weight % with reference to the whole radical polymerizable monomers.

[Chain Transfer Agents]

Aiming at the adjustment of molecular weight, generally used chain transfer agents may be employed.

The chain transfer agents are not specially limited. Examples include mercapatans such as octylmercaptan, dodecylmercaptan, tert-dodecylmercaptan, etc.

[Polymerization Initiators]

Water-soluble radical polymerization initiators may be optionally employed in the present invention. For example, are listed persulfate salts (potassium persulfate, ammonium persulfate, etc.), azo series compounds (4,4'-azobis-4-cyano valeic acid and its salt, 2,2'-azobis(2-amodinopropane) salt, etc. peroxide compounds.

Furthermore, the above-mentioned radical polymerization initiator may be employed in combination with a reducing agent if desired, and may be employed as a redox system initiator. The use of the redox system initiator enables the increase in polymerization activity and the decrease in polymerization temperature. As a result, the reduction in polymerization time may be expected.

The polymerization temperature is not limited if the temperature is higher than the lowest temperature at which the polymerization initiator induces the formation of a radical. The temperature of 50° C. to 90° C. is employed. However, the use of the polymerization initiator such as, for example, a combination of hydrogen peroxide-reducing agent (ascorbic acid, etc.) which enables initiation at room temperature makes it possible to conduct the polymerization at room temperature or lower.

[Surface Active Agents]

Surface active agent is employed in polymerization using the radical polymerizable monomer.

Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate, etc., sulfonic ester salts such as sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

Further, nonionic surfactant also may be employed. Examples are mentioned as polyethyleneoxide, polypropyleneoxide, combination of polypropyleneoxide and polyethyleneoxide, ester of polyethyleneglycol and higher fatty acid, alkylphenol polyethyleneoxide, ester of higher fatty acid and polyethylene glycol, ester of higher fatty acid and polypropyleneoxide, sorbitan ester.

[Colorants]

Colorants include inorganic pigments and organic pigments.

Inorganic Pigments

Inorganic pigments capable of employing in the toner may be employed. Specific inorganic pigments are shown in the following.

Black pigments include, for example, carbon blacks such as furnace black, channel black, acetylene black, thermal black, lamp black, etc., and in addition, magnetic powders such as magnetite, ferrite, etc.

These inorganic pigments may be employed individually or in combination in accordance with requirements. Furthermore, the addition amount of the pigment is generally in the range of 2 to 20 weight parts of a polymer and preferably in the range of 3 to 15 weight parts.

Magnetite mentioned above may be added when used as a magnetic toner. Preferable amount is 20 to 60% by weight in the toner.

Organic Pigments

Organic pigments which may be employed in toner may be employed. In the following, specific organic pigments are shown.

Pigments for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, etc.

Pigments for orange or yellow include C.I. Pigment orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, C.I. Pigment Yellow 156, etc.

Pigments for green or cyan include C.I. Pigment Blue 15, C.I. Pigment Blue 15:2, C.I. Pigment Blue 15:3, C.I. Pigment Blue 16, C.I. Pigment Blue 60, C.I. Pigment Green 7, etc.

Further, as for die, C.I. solvent red 1, C.I. solvent red 49, C.I. solvent red 52, C.I. solvent red 58, C.I. solvent red 63, C.I. solvent red 111, C.I. solvent red 122, C.I. solvent yellow 19, C.I. solvent red 122, C.I. solvent yellow 44, C.I. solvent red 122, C.I. solvent yellow 77, C.I. solvent red 122, C.I. solvent yellow 79, C.I. solvent red 122, C.I. solvent yellow 81, C.I. solvent red 122, C.I. solvent yellow 82, C.I. solvent red 122, C.I. solvent yellow 93, C.I. solvent red 122, C.I. solvent yellow 98, C.I. solvent red 122, C.I. solvent yellow 103, C.I. solvent red 122, C.I. solvent yellow 104, C.I. solvent red 122, C.I. solvent yellow 112, C.I. solvent red 122, C.I. solvent yellow 162, C.I. solvent red 122, C.I. solvent blue 25, C.I. solvent blue 36, C.I. solvent blue 60, C.I. solvent blue 70, C.I. solvent blue 93, C.I. solvent blue 95 may be used.

These organic pigments may be employed individually or in combination of a plurality of them in accordance with requirements. Furthermore, the addition amount of the pigment is generally in the range of 2 to 20 weight parts for a polymer and preferably in the range of 3 to 15 weight parts.

Surface Improving Agents

The colorant may be used after subjecting to surface modification by employing surface improving agent. Specifically, may be preferably employed silane coupling agent, titanium coupling agent, aluminum coupling agent, etc.

[External Additive]

The so-called external additive can be employed for the purpose of improving fluid characteristics or cleaning ability so as to give an adaptability of recycle toner. The external additive includes various inorganic particles, organic particles and lubricant.

Inorganic particles may be used as external. Preferably employed as inorganic particles are fine particles of silica, titania and alumina. These inorganic fine particles are preferably hydrophobic. Specific example of silica fine particles, includes marketing product of R-805 R-976, R-974, R-972, R-812 and R-809 made by Nihon Aerosil Co., Ltd., HVK-2150 and H-200 made by Hoechst Company, and TS-720 TS-530, TS-610, H-5, MS-5 made by Cabot company.

Example of titanium fine particles includes marketing product of T-805 and T-604 made by Nihon Aerosil Co., Ltd., MT-100S, MT-100B, MT-500BS, MT-600, MT-600SS and JA-1, made by Teika company, TA-300SI, TA-500, TAF-130, TAF-510 and TAF-510T made by Fuji Titanium Company, and IT-S, IT-OA, IT-OB, IT-OC made by Idemitsu Kosan Company.

Example of alumina fine particles includes marketing product RFY-C and C-604 made by Nihon Aerosil Co. Ltd., and TTO-55 made by Ishihara Sangyo company is made.

As organic fine particles, spherical organic fine particles having number average primary order particle size of 10 to 2000 nm may be used. Examples of the organic fine particles are listed as homopolymer or copolymer of styrene resin, methylmethacrylate resin.

Example of the lubricant mentioned above includes metallic salt of higher fatty acid such as stearic acid salt of zinc, aluminum, copper and magnesium, oleic acid salt of calcium, zinc, manganese, iron, copper and magnesium, palmitic acid salt of zinc, copper, magnesium and calcium, linoleic acid salt of zinc and calcium, and ricinoleic acid salt of zinc and calcium.

The external additives are preferably contained in amount of 0.1 to 5 weight % with reference to toner amount.

The toner of the present invention is a coalesced type toner obtained by salting out/fusing resin particles comprising releasing agents and colorant particles in a water based medium. By salting out/fusing said resin particles comprising releasing agents, as described above, a toner is obtained in which said releasing agents are finely depressed.

In addition, the toner according to a preferable embodiment of the present invention possesses an uneven surface from the production stage, and a coalesced type toner is obtained by fusing resin particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

<Toner Production Process>

One example of the method for producing the toner of the present invention is as follows:

(1) a dissolution process in which releasing agents are dissolved in monomers and a monomer solution is prepared (2) a dispersion process in which the resulting monomer solution is dispersed into a water based medium (3) a polymerization process in which the resulting water based dispersion of said monomer solution undergoes polymerization so that dispersion (latex) of resin particles comprising said releasing agents is prepared (4) a salting-out/fusion process in which the resulting resin particles and said colorant particles are subjected to salting-out/fusion in a water based medium so as to obtain coalesced particles (toner particles)

(5) a filtration and washing process in which the resulting coalesced particles are collected from the water based medium employing filtration, and surface active agents and the like are removed from said coalesced particles (6) a drying process in which washed coalesced particles are dried, and (7) an external addition process may be included in which external agents are added to the dried coalesced particles.

(Dissolution Process)

Methods for dissolving releasing agents in monomers are not particularly limited.

The dissolved amount of said releasing agents in said monomers is determined as follows: the content ratio of releasing agents is generally 1 to 30 percent by weight with respect of the finished toner, is preferably 2 to 20 percent by weight, and is more preferably 3 to 15 percent by weight.

Further, oil-soluble polymerization initiators as well as other oil-soluble components may be incorporated into said monomer solution.

(Dispersion Process)

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a Water based medium prepared by dissolving a surface active agent at a concentration of lower than its critical micelle concentration.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers. Furthers the diameter of dispersed-particles is 10 to 1,000 nm, and is preferably 30 to 300 nm.

(Polymerization Process)

In the polymerization process, polymerization methods (granulation polymerization methods such as an emulsion polymerization method, a suspension polymerization method, and a seed polymerization method) may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting-Out/Fusion Process)

In the salting-out/fusion process, a colorant particle dispersion is added to a dispersion containing resin particles obtained by said polymerization process so that said resin particles and said colorant particles are subjected to salting-out/fusion in a water based medium.

Further, in said salting-out/fusion process, resin particles as well as colorant particles may be fused with internal agent particles and the like.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration.

Homogenizers to disperse colorants are not particularly limited, and preferably listed are "CLEARMIX", ultrasonic homogenizers, mechanical homogenizers, Manton-Gaulin and pressure type homogenizers, and medium type homogenizers such as sand grinders, Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

The salting-out/fusion process is accomplished as follows. Salting-out agents, containing alkaline metal salts and/or alkaline earth metal salts and the like, are added to water comprising resin particles as well as colorant particles as the coagulant at a concentration of higher than critical aggregation concentration. Subsequently, the resulting aggregation is heated above the glass transition point of said resin particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting-out/fusion process, it is preferable that hold-over time after the addition of salting-out agents is as short as possible. Namely it is preferable that after the addition of salting-out agents, dispersion containing resin particles and colorant particles is heated as soon as possible and heated to a temperature higher than the glass transition point of said resin particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resin particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion containing resin particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resin particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing Process)

In said filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing Buchner's funnel and the like, a filtration method which is carried out employing a filter press, and the like.

(Drying Process)

This process is a process to dry the washed colored particles.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried colored particles is preferably not more than 5 percent by mass, and is more preferably not more than 2 percent by mass.

Further, when dried colored particles are aggregated due to weak attractive forces among particles, aggregates may be subjected to pulverization treatment. Herein, employed as pulverization devices may be mechanical pulverization devices such as a jet mill, a HENSCHEL MIXER, a coffee mill, a food processor, and the like.

(Addition Process of External Additives)

This process is one in which external additives are added to dried colored particles.

Listed as devices which are employed for the addition of external additives, may be various types of mixing devices known in the art, such as tubular mixers, HENSCHEL MIXERs, Nauter mixers, V-type mixers, and the like.

The proportion of number of toner particles having a diameter of at most 0.7×(Dp50) Proportion of is 10 percent or less. It is preferable to control the temperature during the salting-out/fusion narrow for obtaining toner particles satisfying such condition. More in concrete temperature is elevated as fast as possible. The time for elevation is preferably 30 minutes or less, more preferably 10 minutes or less, and the elevation rate is preferably 1 to 15° C./minutes.

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resin particles as well as colorant particles so as to be incorporated into the toner, another is one in which said charge control agents are added to resin particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume basis median diameter of said magnetic particles is preferably 15 to 100 μm, and is more preferably 25 to 80 μm.

The volume basis median diameter of said carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

The following describes the image forming apparatus using an organic photoreceptor:

The image forming apparatus 1 shown in FIG. 1 is a digital image forming apparatus. It comprises an image reading section A, an image processing section B, an image forming section C, and a transfer paper conveyance section D as a transfer paper conveyance means.

An automatic document feed means for automatically feeding documents is arranged on the top of the image reading section A. The documents placed on the document platen as conveyed sheet by sheet by means of a document conveying roller 12, and the image is read at the reading position 13*a*. The document having been read is ejected onto a document ejection tray 14 by the document conveying roller 12.

In the meantime, the image of the document placed on the plate glass 13 is read by the reading operation at the speed v by the first mirror unit 15 consisting of an illumination lamp constituting a scanning optical system and a first mirror, and by the movement of the second mirror unit 16 consisting of the second and third mirrors located at the V-shaped position at the speed v/2 in the same direction.

The scanned images are formed on the light receiving surface of an image-capturing device (CCD) as a line sensor through the projection lens 17. The linear optical images formed on the image-capturing device (CCD) are sequentially subjected to photoelectric conversion into electric signals (luminance signals). Then they are subjected to analog-to-digital conversion, and then to such processing as density conversion and filtering in the image processing section B. After that, image data is stored in the memory.

The image forming section C as an image forming unit comprises: a drum-formed photoreceptor 21 as an image carrier; a charging device (charging process) 22 for charging the photoreceptor 21 on the outer periphery; a potential detecting section 220 for detecting the potential on the surface of the charged photoreceptor; a developing section (developing process) 23; a transfer/conveyance belt apparatus 45 as a transfer section (transfer process); a cleaning apparatus (cleaning process) 26 for the photoreceptor 21; and a PCL (pre-charge lamp) 27 as an optical electric charge eliminator (residual potential eliminating process).

These components are arranged in the order of operations. Further, a reflected density detecting section 222 for measuring the reflected density of the patch image developed on the photoreceptor 21 is provided downstream from the developing section 23. An organic photoreceptor of the present invention is used as the photoreceptor 21, and is driven in the clockwise direction as illustrated.

The rotating photoreceptor 21 is electrically charged uniformly by the charging device 22. After that, image exposure is performed based on the image signal called up from the memory of the image processing section B by the exposure optical system as an image exposure section (image exposure process) 30. In the exposure optical system as an image exposure section 30—a writing section—, the optical path is bent by a reflection mirror 32 through a rotating polygon mirror 31, fθ lens 34, and cylindrical lens 35, using the laser diode (not illustrated) as a light emitting source, whereby main scanning is performed. Exposure is carried out at position Ao with reference to the photoreceptor 21, and an electrostatic latent image is formed by the rotation (sub-scanning) of the photoreceptor 21.

In an image forming apparatus according to a preferable embodiment of the present invention, at the time of forming the electrostatic latent image on the photoreceptor, the semiconductor laser or light emitting diode with an oscillation wavelength of 350 to 500 nm is used as the image exposure light source. By using such an image exposure light source, condensing the exposure light dot diameter in the main scanning direction of writing to 10 to 50 μm, and by carrying out digital exposure on the surface of the organic photoreceptor it is possible to obtain an electro-photographic image with a resolution of more than 600 dpi (dpi: dots per inch—number of dots per 2.54 cm) and up to 2500 dpi.

The spot diameter of the exposure beam is a diameter of a perfect circle area where an area corresponding to an intensity of the exposure beam being a light intensity of $1/e^2$ or more of a peak intensity is converted into the perfect circle.

The optical beams used can be a scanning optical system using a semiconductor laser or a fixed scanner using LEDs, etc. The light intensity distribution can be Gaussian distribution or Lorentz distribution, and in either case, the area with a light intensity of $1/e^2$ or more than the peak intensity is considered as the exposure dot diameter according to the present invention.

The electrostatic latent image on the photoreceptor 21 is developed and reversed by the developing means 23, and a visible toner image is formed on the surface of the photoreceptor 21. In the image forming method of the present invention, it is desirable to use a polymer toner as the developing agent used in said development means. By combining the use of polymer toner with uniform shape or particle distribution with an organic photoreceptor according to the present invention, it is possible to obtain an electro-photographic image with increased sharpness and good quality.

In the transfer paper conveyance section D, sheet feed units 41(A), 41(B) and 41(C) as a transfer sheet storage means are arranged below the image forming unit, wherein the transfer sheets P having different sizes are stored. A manual sheet feed unit 42 for manual feed of the sheets of paper is provided on the side. The transfer sheets P selected by either of the two are fed along a sheet conveyance path 40 by a guide roller 43, and are temporarily suspended by the sheet feed registration roller 44 for correcting the inclination and deviation of the transfer sheets P. Then these transfer sheets P are again fed and guided by the sheet conveyance path 40, pre-transfer roller 43*a*, paper feed path 46 and entry guide plate 47. The toner image on the photoreceptor 21 is transferred to the transfer sheet P at the transfer position Bo by a transfer electrode 24 and a separator electrode 25, while being carried by the transfer/conveyance belt 454 of the transfer/conveyance belt apparatus 45. The transfer sheet P is separated from the surface of the photoreceptor 21 and is brought to a fixing apparatus 50 as a fixing means by the transfer/conveyance belt apparatus 45.

The fixing apparatus 50 contains a fixing roller 51 and a pressure roller 52. When the transfer sheet P passes between the fixing roller 51 and pressure roller 52, toner is fixed in position by heat and pressure. With the toner image having been fixed thereon, the transfer sheet P is ejected onto the ejection tray 64.

The above description is concerned with the case where an image is formed on one side of the transfer sheet. In the case of duplex copying, the ejection switching member 170 is switched and the transfer sheet guide 177 is opened. The transfer sheet P is fed in the direction of an arrow showed in a broken line.

Further, the transfer sheet P is fed downward by the conveyance device 178 and is switched back by the sheet reversing section 179. With the trailing edge of the transfer sheet P becoming the leading edge, the transfer sheet P is conveyed into the sheet feed unit 130 for duplex copying.

The conveyance guide 131 provided on the sheet feed unit 130 for duplex copying is moved in the direction of sheet feed by the transfer sheet P. Then the transfer sheet P is fed again by the sheet feed roller 132 and is led to the sheet conveyance path 40.

As described above, the transfer sheet P is again fed in the direction of the photoreceptor 21, and the toner image is transferred on the reverse side of the transfer sheet P. After the image has been fixed by the fixing section 50, the transfer sheet P is ejected to the ejection tray 64 through a roller pair 63.

The image processing apparatus can be configured in such a way that the components such as the aforementioned photoreceptor, developing device and cleaning device are integrally combined into a process cartridge, and this unit is removably mounted on the apparatus proper. It is also possible to arrange such a configuration that at least one of the charging device, image exposure device, developing device, transfer electrode, separator electrode and cleaning device is supported integrally with the photoreceptor, so as to form a process cartridge that, as a removable single unit, is mounted on the apparatus proper, using a guide means such as a rail of the apparatus proper.

Figure 2:
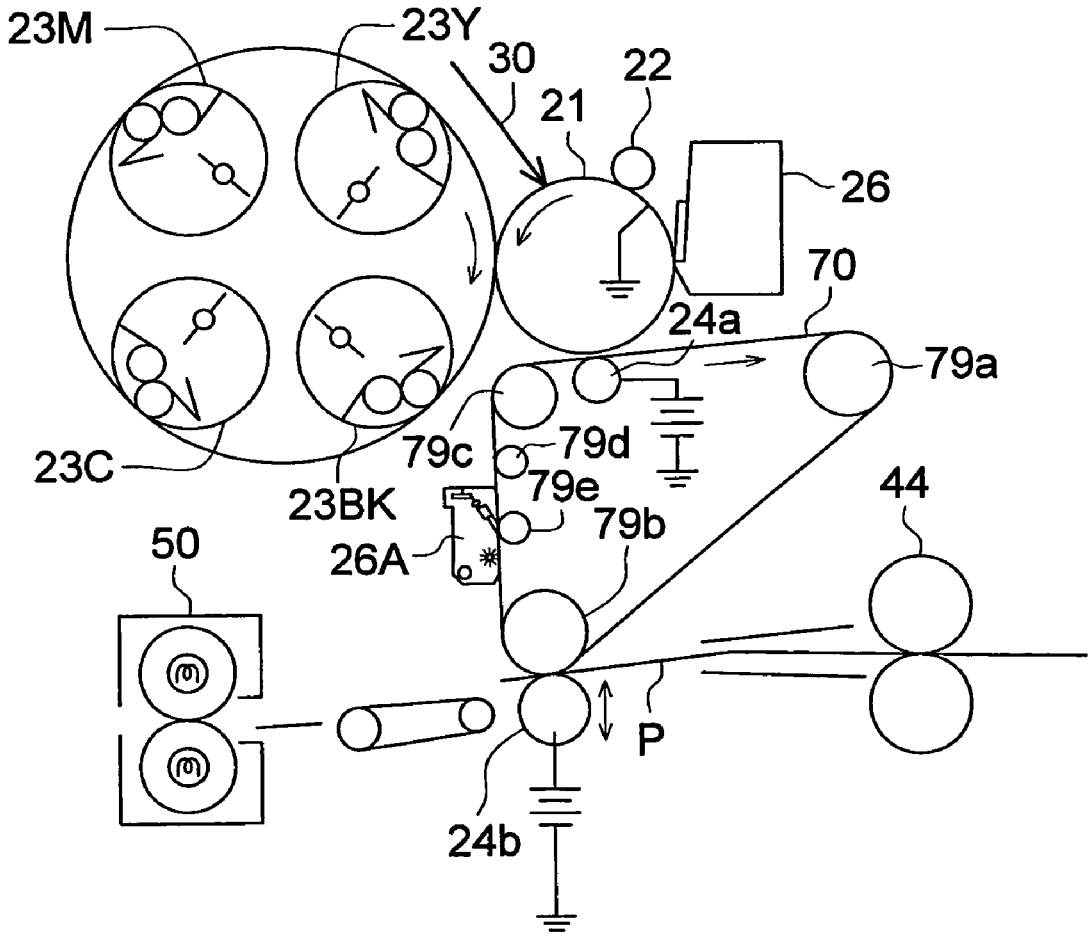
FIG. 2 is a sectional schematic view of a color image forming apparatus employing an organic photoreceptor relating to the invention.

Next, FIG. 2 shows the cross-sectional configuration view diagram of a color image forming apparatus using an organic photoreceptor according to the present invention (a copier or a laser beam printer having at least a charging means, an exposing means, a plurality of developing means, image transfer means, cleaning means, and intermediate image transfer body around the organic photoreceptor). An elastic material with a medium level of electrical resistivity is being used for the belt shaped intermediate image transfer body 70.

In this figure, 1 is a rotating drum type photoreceptor that is used repetitively as the image carrying body, and is driven to rotate with a specific circumferential velocity in the anti-clockwise direction shown by the arrow.

During rotation, the photoreceptor 1 is charged uniformly to a specific polarity and potential by the charging means 2, after which it receives from the image exposing means 3 not shown in the figure image exposure by the scanning exposure light from a laser beam modulated according to the time-serial electrical digital pixel signal of the image information thereby forming the electrostatic latent image corresponding to the yellow (Y) color component of the target color image.

Next, this electrostatic latent image is developed by the yellow (Y) developing means: developing process (yellow color developer) 4Y using the yellow toner which is the first color. At this time, the second to the fourth developing means (magenta color developer, cyan color developer, and black color developer) 4M, 4C, and 4Bk are each in the operation switched-off state and do not act on the photoreceptor 1, and the yellow toner image of the above first color does not get affected by the above second to fourth developers.

The intermediate image transfer body 70 is wound over the rollers 79*a*, 79*b*, 79*c*, 79*d*, and 79*e* and is driven to rotate in a clockwise direction with the same circumferential speed as the photoreceptor 1.

The yellow toner image of the first color formed and retained on the photoreceptor 1 is, in the process of passing through the nip section between the photoreceptor 1 and the intermediate image transfer body 70, intermediate transferred (primary transferred) successively to the outer peripheral surface of the intermediate image transfer body 70 due to the electric field formed by the primary transfer bias voltage applied from the primary transfer roller 24*a* to the intermediate image transfer body 70.

The surface of the photoreceptor 1 after it has completed the transfer of the first color yellow toner image to the intermediate image transfer body 70 is cleaned by the cleaning apparatus 6*a*.

In the following, in a manner similar to the above, the second color magenta toner image, the third color cyan toner image, and the fourth color black toner image are transferred successively on to the intermediate image transfer body 70 in a superimposing manner, thereby forming the superimposed color toner image corresponding to the desired color image.

The secondary transfer roller 5*b* is placed so that it is supported by bearings parallel to the secondary transfer opposing roller 79*b* and pushes against the intermediate image transfer body 70 from below in a separable condition.

In order to carry out successive overlapping transfer of the toner images of the first to fourth colors from the photoreceptor 1 to the intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from the photoreceptor 1 to the intermediate image transfer body 70, the secondary transfer roller 5*b* and the intermediate image transfer body cleaning means 6*b* can be separated from the intermediate image transfer body 70.

The transfer of the superimposed color toner image transferred on to the belt shaped intermediate image transfer body on to the transfer material P which is the second image supporting body is done when the secondary transfer roller 5*b* is in contact with the belt of the intermediate image transfer body 70, and the transfer material P is fed from the corresponding sheet feeding resist roller 23 via the transfer sheet guide to the contacting nip between the secondary transfer roller 5*b* and the intermediate image transfer body 70 at a specific timing. The secondary transfer bias voltage is applied from the bias power supply to the secondary image transfer roller 5*b*. Because of this secondary transfer bias voltage, the superimposed color toner image is transferred (secondary transfer) from the intermediate image transfer body 70 to the transfer material P which is the second image supporting body. The transfer material P which has received the transfer of the toner image is guided to the fixing means 24 and is heated and fixed there.

Figure 3:
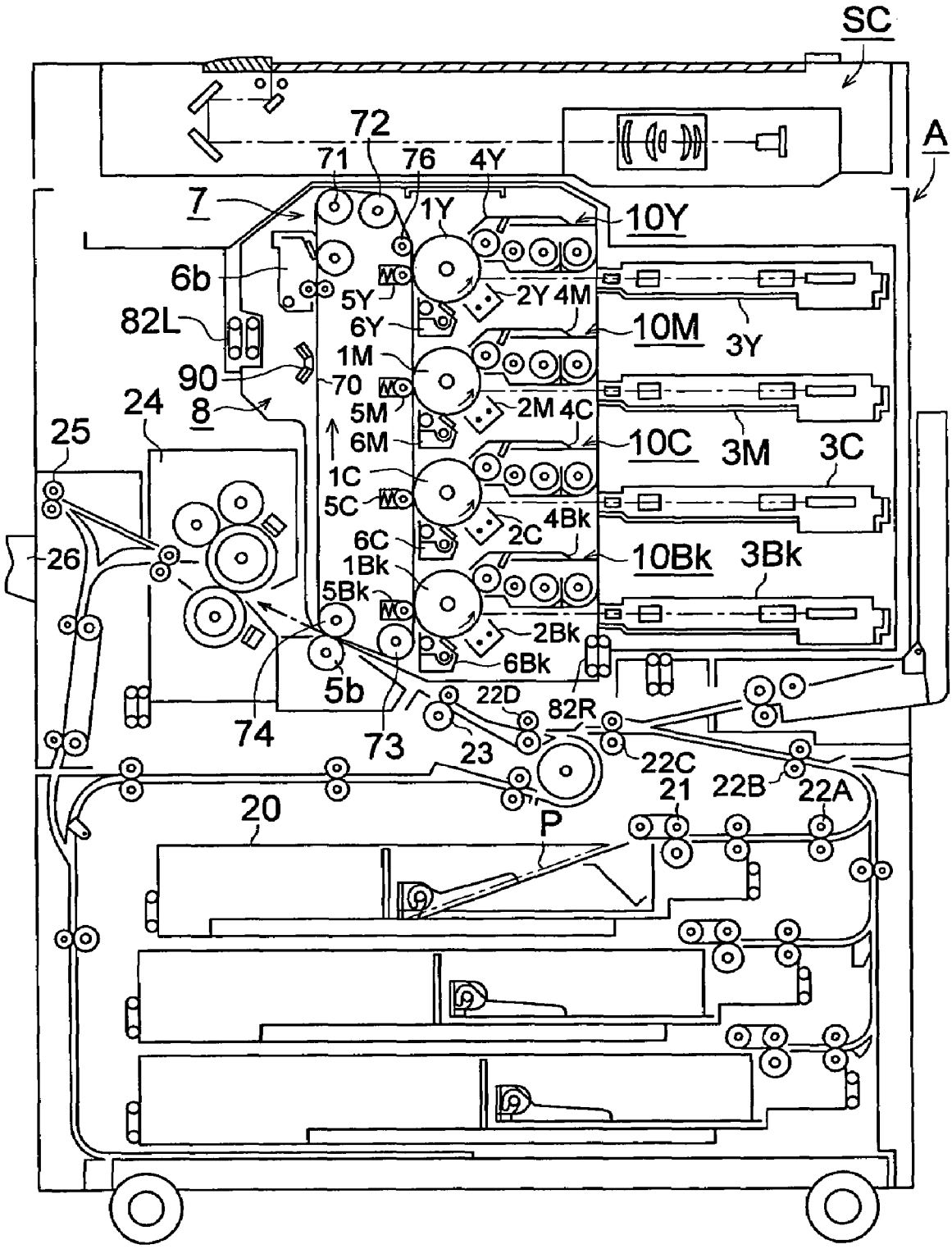
FIG. 3 is a sectional schematic view of a color image forming apparatus showing another embodiment according to the invention.

FIG. 3 is a cross-sectional configuration view diagram of a color image forming apparatus showing a preferred embodiment of the present invention.

This color image forming apparatus is of the so called tandem type color image forming apparatus, and comprises four sets of image forming sections (image forming units) 10Y, 10M, 10C, and 10Bk, an endless belt shaped intermediate image transfer body unit 7, a sheet feeding and transportation means 21, and a fixing means 24. The original document reading apparatus SC is placed on top of the main unit A of the image forming apparatus.

The image forming section 10Y that forms images of yellow color comprises a charging means (charging process) 2Y, an exposing means (exposing process) 3Y, a developing means (developing process) 4Y, a primary transfer roller 5Y as a primary transfer means (primary transfer process), and a cleaning means 6Y all placed around the drum shaped photoreceptor 1Y which acts as the first image supporting body. The image forming section 10M that forms images of magenta color comprises a drum shaped photoreceptor 1M which acts as the first image supporting body, a charging means 2M, an exposing means 3M, a developing means 4M, a primary transfer roller 5M as a primary transfer means, and a cleaning means 6M. The image forming section 10C that forms images of cyan color comprises a drum shaped photoreceptor 1C which acts as the first image supporting body, a charging means 2C, an exposing means 3C, a developing means 4C, a primary transfer roller 5C as a primary transfer means, and a cleaning means 6C. The image forming section 10Bk that forms images of black color comprises a drum shaped photoreceptor 1Bk which acts as the first image supporting body, a charging means 2Bk, an exposing means 3Bk, a developing means 4Bk, a primary transfer roller 5Bk as a primary transfer means, and a cleaning means 6Bk.

Said four sets of image forming units 10Y, 10M, 10C, and 10Bk are constituted, centering on the photosensitive drums 1Y, 1M, 1C, and 1Bk, by the rotating charging means 2Y, 2M, 2C, and 2Bk, the image exposing means 3Y, 3M, 3C, and 3Bk, the rotating developing means 4Y, 4M, 4C, and 4Bk, and the cleaning means 5Y, 5M, 5C, and 5Bk that clean the photosensitive drums 1Y, 1M, 1C, and 1Bk.

Said image forming units 10Y, 10M, 10C, and 10Bk, all have the same configuration excepting that the color of the toner image formed in each unit is different on the respective photosensitive drums 1Y, 1M, 1C, and 1Bk, and detailed description is given below taking the example of the image forming unit 10Y.

The image forming unit 10Y has, placed around the photosensitive drum 1Y which is the image forming body, a charging means 2Y (hereinafter referred to merely as the charging unit 2Y or the charger 2Y), the exposing means 3Y, the developing means 4Y, and the cleaning means 5Y (hereinafter referred to merely as the cleaning means 5Y or as the cleaning blade 5Y), and forms yellow (Y) colored toner image on the photosensitive drum 1Y. Further, in the present preferred embodiment, at least the photosensitive drum 1Y, the charging means 2Y, the developing means 4Y, and the cleaning means 5Y in this image forming unit 10Y are provided in an integral manner.

The charging means 2Y is a means that applies a uniform electrostatic potential to the photosensitive drum 1Y, and a corona discharge type of charger unit 2Y is being used for the photosensitive drum 1Y in the present preferred embodiment.

The image exposing means 3Y is a means that carries out light exposure, based on the image signal (Yellow), on the photosensitive drum 1Y to which a uniform potential has been applied by the charging means 2Y, and forms the electrostatic latent image corresponding to the yellow color image, and an array of light emitting devices LEDs and imaging elements (product name: selfoc lenses) arranged in the axial direction of the photosensitive drum 1Y or a laser optical system etc., is used as this exposing means 3Y.

The intermediate image transfer body unit 7 in the shape of an endless belt is wound around a plurality of rollers, and has an endless belt shaped intermediate image transfer body 70 which acts as a second image carrying body in the shape of a partially conducting endless belt which is supported in a free to rotate manner.

The images of different colors formed by the image forming units 10Y, 10M, 10C, and 10Bk, are successively transferred on to the rotating endless belt shaped intermediate image transfer body 70 by the primary transfer rollers 5Y, 5M, 5C, and 5Bk acting as the primary image transfer means, thereby forming the synthesized color image. The transfer material P as the transfer material stored inside the sheet feeding cassette 20 (the supporting body that carries the final fixed image: for example, plain paper, transparent sheet, etc.,) is fed from the sheet feeding means 21, pass through a plurality of intermediate rollers 22A, 22B, 22C, and 22D, and the resist roller 23, and is transported to the secondary transfer roller 5*b* which functions as the secondary image transfer means, and the color image is transferred in one operation of secondary image transfer on to the transfer material P. The transfer material P on which the color image has been transferred is subjected to fixing process by the fixing means 24, and is gripped by the sheet discharge rollers 25 and placed above the sheet discharge tray 26 outside the equipment. Here, the transfer supporting body of the toner image formed on the photoreceptor of the intermediate transfer body or of the transfer material, etc. is comprehensively called the transfer media.

On the other hand, after the color image is transferred to the transfer material P by the secondary transfer roller 5*b* functioning as the secondary transfer means, the endless belt shaped intermediate image transfer body 70 from which the transfer material P has been separated due to different radii of curvature is cleaned by the cleaning means 6*b* to remove all residual toner on it.

During image forming, the primary transfer roller 5Bk is at all times pressing against the photoreceptor 1Bk. Other primary transfer rollers 5Y, 5M, and 5C come into pressure contact respectively with their corresponding photoreceptor 1Y, 1M, and 1C only during color image forming.

The secondary transfer roller 5*b* comes into pressure contact with the endless belt shaped intermediate transfer body 70 only when secondary transfer is to be made by passing the transfer material P through this.

Further, the chassis 8 can be pulled out via the supporting rails 82L and 82R from the body A of the apparatus.

The chassis 8 comprises the image forming sections 10Y, 10M, 10C, and 10Bk, and the endless belt shaped intermediate image transfer body unit 7.

The image forming sections 10Y, 10M, 10C, and 10Bk are arranged in column in the vertical direction. The endless belt shaped intermediate image transfer body unit 7 is placed to the left side in the figure of the photosensitive drums 1Y, 1M, 1C, and 1Bk. The endless belt shaped intermediate image transfer body unit 7 comprises the endless belt shaped intermediate image transfer body 70 that can rotate around the rollers 71, 72, 73, and 74, the primary image transfer rollers 5Y, 5M, 5C, and 5Bk, and the cleaning means 6*b*.

The image forming method according to the present invention can be applied in general to all electro-photographic apparatuses such as electro-photographic copiers, laser printers, LED printers, and liquid crystal shutter type printers, and in addition, it is also possible to apply the present invention to a wide range of apparatuses applying electro-photographic technology, such as displays, recorders, light printing equipment, printing screen production, and facsimile equipment.

Although examples are given and this invention is hereafter explained to details, the aspect of this invention is not limited to this. Incidentally, "part" in the following sentences represents "parts by mass".

Manufacture of Photoreceptor 1

Photoreceptor 1 was manufactured as follows.

Intermediate Layer

The washed cylinder type aluminum base support, which surface has 10 points surface roughness Rz of 0.45 μm by subjecting to cutting process, was subjected to coating with the following intermediate layer coating composition by dipping and thereafter drying for 30 minutes at 120° C., an intermediate layer having dry thickness of 20 μm was prepared.

The following intermediate layer dispersion liquid was diluted twice with the same mixed solvent, and filtered after settling for overnight (filter; Nihon Pall Ltd. company make RIGIMESH filter nominal filtering capability: 5 μm, pressure; 50 kPa), whereby the intermediate layer coating solution was produced.

| (Preparation of intermediate layer dispersion) | |
|---|---|
| Binder resin, (exemplified Polyamide N-1) | 1 part (1.0 part by volume) |
| Rutile type titanium oxide (primary particle diameter of 35 nm: a titanium oxide pigment which was subjected to surface treatment with dimethylpolysiloxane having a hydroxyl group at it's end and whose degree of hydrophobilization was adjusted to 33) | 5.6 parts |
| Ethanol/n-propylalcohol/THF (= 45/20/30 mass ratio) | 10 parts |

The above-mentioned composites were mixed, dispersion was performed for 10 hours by a batch system, using a sand mill homogenizer, and whereby intermediate layer dispersion liquid was produced.

| <Electric charge generating layer (CGL)> | |
|---|---|
| Electric charge generating material (CGM): the above CGM-1 | 24 parts |
| Polyvinyl butyral resin "S-LEC BL-1" (made by Sekisui Chemical Co., Ltd.) | 12 parts |
| 2-butanone/cyclohexanone = 4/1 (v/v) | 300 parts |

The above-mentioned compositions were mixed and dispersed using the sand mill, thereby a charge generating layer coating liquid was prepared. This coating liquid was applied by a dip coating method on the intermediate layer, thereby an electric charge generating layer of 0.5 μm dry film thickness was formed.

| <Charge transporting layer (CTL)> | |
|---|---|
| Charge transporting material (the above CTM-4) | 225 parts |
| Polycarbonate (Z300: manufactured by Mitsubishi Gas Chemical Company INC. company) | 300 parts |
| Antioxidant (AO 1-1) | 6 parts |
| Dichloromethane | 2000 parts |
| Silicone oil (KF-54: made by a Shin-Etsu Chemical Co., Ltd. company) | 1 Part |

The above-mentioned compositions were mixed and dissolved, thereby a charge transporting layer coating liquid 1 was prepared. This coating liquid was coated on the charge generating layer by a dip coating method, and was dried for 70 minutes at 110° C., thereby a charge transporting layer having a dry film thickness of 14.0 μm was formed and photoreceptor 1 was prepared.

Manufacture of Photoreceptors 2 to 10

Photoreceptors 2 to 10 were manufactured in the same way for photoreceptor 1 except that a layer thickness of an intermediate layer and a layer thickness of a charge transporting layer were changed as shown in Table 1.

Manufacture of Photoreceptors 11 to 18

Photoreceptors 11 to 18 were manufactured in the same way for photoreceptor 1 except that a kind of an intermediate layer, a charge generating material of a charge generating layer was changed from CGM-1 to CGM-2, CGM-3 and CGM-4 as shown in Table 1, a charge transporting material of a charge transporting layer was changed from CTM-1 to CTM-2, CTM-3 and CTM-5, and the layer thickness of the charge transporting layer was made as shown in Table 1.

Manufacture of Photoreceptor 19

Photoreceptor 19 was manufactured in the same way for photoreceptor 1 except that the rutile type titanium oxide of the intermediate layer was removed.

TABLE 1

| Photo-receptor No. | Inter. Layer No. | Inter. Layer Thickness (μm) | Charge Generating material of CGL | Charge Transport Material of CTL | CTL Layer Thickness (μm) | Photo-sensitive layer (Total layer thickness of CGL and CTL) (μm) | Ratio A/B | In/out Of Invention |
|---|---|---|---|---|---|---|---|---|
| 1 | 1 | 20 | CGM-1 | CTM-4 | 14 | 14.5 | 1.38 | In |
| 2 | 1 | 25 | CGM-1 | CTM-4 | 8 | 8.5 | 2.94 | In |
| 3 | 1 | 25 | CGM-1 | CTM-4 | 7.5 | 8.0 | 3.13 | In |
| 4 | 1 | 9 | CGM-1 | CTM-4 | 7.5 | 8.0 | 1.13 | In |
| 5 | 1 | 4 | CGM-1 | CTM-4 | 14 | 14.5 | 0.28 | Out |
| 6 | 1 | 27 | CGM-1 | CTM-4 | 14 | 14.5 | 1.86 | Out |
| 7 | 1 | 9 | CGM-1 | CTM-4 | 8 | 8.5 | 1.06 | In |
| 8 | 1 | 18 | CGM-1 | CTM-4 | 17 | 17.5 | 1.03 | In |
| 9 | 1 | 10 | CGM-1 | CTM-4 | 6 | 6.5 | 1.54 | Out |
| 10 | 1 | 10 | CGM-1 | CTM-4 | 19 | 19.5 | 0.51 | Out |
| 11 | 2 | 20 | CGM-2 | CTM-4 | 14 | 14.5 | 1.38 | In |
| 12 | 3 | 20 | CGM-2 | CTM-1 | 14 | 14.5 | 1.38 | In |
| 13 | 4 | 20 | CGM-2 | CTM-2 | 10 | 10.5 | 1.90 | In |
| 14 | 5 | 20 | CGM-3 | CTM-3 | 14 | 14.5 | 1.38 | In |
| 15 | 6 | 20 | CGM-4 | CTM-5 | 14 | 14.5 | 1.38 | In |
| 16 | 7 | 20 | CGM-3 | CTM-4 | 14 | 14.5 | 1.38 | In |
| 17 | 8 | 20 | CGM-1 | CTM-4 | 14 | 14.5 | 1.38 | Out |
| 18 | 9 | 20 | CGM-1 | CTM-4 | 14 | 14.5 | 1.38 | Out |
| 19 | 10 | 20 | CGM-1 | CTM-4 | 14 | 14.5 | 1.38 | Out |

Further, the content of the intermediate layer in Table 1 is described in Table 2.

TABLE 2

| | Intermediate Layer | | | | | | |
|---|---|---|---|---|---|---|---|
| | Kind and surface treatment of inorganic particles | | | Binder resin | | | |
| Intermediate Layer No. | Kind of Particles | Number average primary particle diameter (nm) | Treatment | Kind | Fuse heat (J/g) | Water absorption ratio (Mass %) | Ratio *5 (Mol %) |
| 1 | A1 | 35 | *1 | N-1 | 0 | 1.9 | 100 |
| 2 | A1 | 35 | *2 | N-3 | 0 | 2.8 | 45 |
| 3 | A2 | 35 | *3 | N-7 | 28 | 3.8 | 60 |
| 4 | A1 | 180 | *1 | N-1 | 0 | 1.9 | 100 |
| 5 | A1 | 35 | *1 | N-1 | 0 | 1.9 | 100 |
| 6 | A1 | 5 | *1 | N-1 | 0 | 1.9 | 100 |
| 7 | Z | 100 | *4 | N-1 | 0 | 1.9 | 100 |
| 8 | A1 | 2 | *1 | N-1 | 0 | 1.9 | 100 |
| 9 | Z | 220 | *4 | N-1 | 0 | 1.9 | 100 |
| 10 | — | — | — | N-1 | 0 | 1.9 | 100 |

In Table 2,
A1 is a rutile type titanium oxide,
A2 is an anatase form titanium oxide,
Z is zinc oxide,
*1 is a copolymer (molar ratio 1:1) of methyl hydrogen siloxane and dimethyl siloxane,
*2 is a copolymer (molar ratio 1:1) of methyl hydrogen siloxane and methyl ethyl siloxane,
*3 is methyl hydrogen poly siloxane,
*4 is a primary treatment: silica alumina and a secondary treatment: methyltrimethoxysilane, and
*5 is a ration of unit structure having a carbon number of 7 or more.

Incidentally, in Table 2, surface treatment shows the substance used for the surface treatment performed on the surface of particles. (However, silica alumina of the primary treatment means silica alumina deposited on the particle surface).

The heat of fusion and the water absorbing degree were measured as follows:

Measurement of Heat of Fusion

Measuring apparatus: Shimadzu Flow Rate Differential Scanning Calorimeter DSC-50 manufactured by Shimadzu Corporation.

Measuring condition: The sample to be measured was set in the measuring apparatus and measurement was stated at a room temperature (24° C.). The temperature was raised by 200° C. in a rate of 5° C. per minute and then cooled by the room temperature in a rate of 5° C. per minute. Such the operation was repeated two times and the heat of fusion was calculated from the area of the endothermic peak caused by the fusion in the course the secondary temperature rising.

Measuring Condition of Water Absorption Degree

The sample to be measured was satisfactorily dried at a temperature of from 70 to 80° C. spending 3 to 4 hours and the sample was precisely weighed. After that the sample was put into deionized water kept at 20° C. and taken out after a designated period and water adhered at the surface of the sample was wiped off by a clean cloth, and then the sample was weighed. Such the operation was repeated until the increasing of the weight was saturated. Thus measured increased weight of the sample was divided by the initial weight. The quotient was defined as the water absorption degree.

In the Table 2, "Ratio of structural unit having 7 or more carbon atoms" is the ratio in mole-% of the structural unit having 7 or more carbon atoms between the amide bonds in the structural unit.

Toner used in the present invention and developer using the toner were prepared.

Preparation of Latex

A solution composed of 2760 g of purified water and 7.08 g of an anionic surfactant (sodium dodecylbenzenesulfonate: SDS), was placed into a 500.0 ml separable flask on which a stirrer, temperature sensor, cooler and nitrogen gas introducing device were attached. Then the contents of the flask were heated to 80° C. while stirring at a rate of 230 rpm under the flow of nitrogen gas. Alternatively, 72.0 g of Exemplified Compound 19 was put into a monomer liquid composed of 115.1 g of styrene, 42.0 g of n-butyl acrylate, and 10.9 g of methacrylic acid and dissolved by heating at 80° C., whereby a monomer liquid was produced.

The heated monomer liquid was placed into the flask and mixed with the surfactant solution after which it was dispersed by a mechanical dispersing machine having a cycling circuit to form emulsified particles of a uniform diameter. Then, a solution of 0.84 g of a polymerization initiator (potassium persulfate: KPS) dissolved in 200 g of deionized water, was added to the emulsion. The resulting liquid was heated and stirred at 80° C. for 3 hours to prepare latex particles.

Thereafter, a solution of 7.73 g of the polymerization initiator (KPS) dissolved in 240 ml of deionized water, was added to the above-prepared latex. After 15 minutes, a mixture of 383.6 g of styrene, 140.0 g of n-butyl acrylate, 36.4 g of methacrylic acid and 14.0 g of n-octyl-3-mercaptopropionate was gradually dripped into the latex over 120 minutes at 80° C. After completion of the dropping, the resulting liquid was further heated and stirred for 60 minutes and then cooled to 40° C. to obtain a latex. The obtained latex is referred as Latex 1.

<Preparation Example of Toner>

Preparation of Colored Particles 1

In 160 ml of deionized water, 9.2 g of sodium n-dodecylsulfate was dissolved with stirring. Into this solution, 20 g of carbon black REGAL 330R, produced by Cabot Co., Ltd., was gradually added while stirring and dispersed in a dispersing machine CLEAMIX. The particle size of the dispersed particles measured by an electrophoresis scatter light meter ELS-800, manufactured by Ootsuka Denshi Co., Ltd., was 112 nm in weight average particle diameter. This dispersion is referred to as Colorant Dispersion 1.

Into a 5 liter four-mouth flask, to which a temperature sensor, cooler, nitrogen gas introducing device and stirrer were attached, 1250 g of Latex 1, 0.2000 ml of deionized water and Colorant Dispersion 1 were placed, and then stirred. After adjusting the temperature to 30° C., pH value of the mixture was adjusted to 10.0 by adding a 5 moles/liter sodium hydroxide solution.

Then a solution of 52.6 g of magnesium chloride hexahydrate dissolved in 72 ml of deionized water was added at 30° C. over 5 minutes while stirring. The resultant was stood for 2 minutes and heated to 50° C. over 5 minutes; the temperature raising rate was 12° C./minute. In such a situation, the particle size was measured by Coulter Counter TA III and the growth of the particles was stopped by adding a solution of 115 g of sodium chloride dissolved in 700 ml of deionized water at the time when the volume average diameter of the particles reached 4.3 μm. The mixture was further stirred for 8 hours at a temperature of 85° C.±2° C. for salting off/adhesion by fusion of the particles.

Thereafter, the system was cooled to 30° C. at a cooling rate of 6 ° C./minute; then the pH was adjusted to 2.0 by addition of hydrochloric acid, and stirring was stopped. Thus formed colored particles were filtered and washed, and dried by air heated to 40° C. The thus obtained colored particles are referred to as Colored Particles 1.

Preparation of Colored Particles 2 Through 11

Colored Particles 2 through 11 were prepared in the same manner as Colored Particles 1 except that the preparation condition was changed as shown in Table 3.

TABLE 3

| Colored particle No. | Added amount of magnesium chloride | Heating Rate ° C./Min. | salting-out/fusion Liquid Temp. | Holding Time (hours) | Diameter *1 (μm) |
|---|---|---|---|---|---|
| 1 | 52.6 g | 12 | 85 ± 2° C. | 8 | 4.3 |
| 2 | 52.6 g | 20 | 90 ± 2° C. | 6 | 4.3 |
| 3 | 52.6 g | 5 | 90 ± 2° C. | 6 | 4.1 |
| 4 | 26.3 g | 12 | 85 ± 2° C. | 8 | 4.3 |
| 5 | 78.9 g | 12 | 85 ± 2° C. | 8 | 4.3 |
| 6 | 52.6 g | 12 | 85 ± 2° C. | 8 | 3.5 |
| 7 | 38.6 g | 12 | 85 ± 2° C. | 8 | 3.4 |
| 8 | 78.9 g | 12 | 85 ± 2° C. | 8 | 3.2 |
| 9 | 52.6 g | 12 | 85 ± 2° C. | 8 | 5.6 |
| 10 | 45.8 g | 12 | 85 ± 2° C. | 8 | 6.8 |
| 11 | 52.6 g | 12 | 85 ± 2° C. | 8 | 8.9 |

*1 Growth stopping particle diameter

Preparation of Toner Particles

To each of Colored Particles 1 through 11, 1% by mass of hydrophobic silica having a number average primary particle diameter of 12 nm and a hydrophobicity of 68 and 1% by mass of hydrophobic titanium oxide having a number average primary particle diameter of 20 nm and a hydrophobicity of 63 were added and mixed by a HENSCHEL MIXER. Thus Toner 1 through Toner 11 were obtained. The average particle diameter and the particle distribution were measured and shown in Table 4.

Incidentally, with regard to physical properties such as average particle diameter and particle size distribution, even though any of coloring particles which are original shape of toner and toner (usually, external additive agents are added to coloring particles), there is no substantial difference in the value.

TABLE 4

| Toner No. | Diameter *1 (Dv50) (μm) | Diameter *2 (Dp50) (μm) | Dv50/Dp50 | Diameter *3 (Dv75) (μm) | Diameter *4 (Dp75) (μm) | Dv75/Dp75 | Number % *5 |
|---|---|---|---|---|---|---|---|
| 1 | 4.6 | 4.3 | 1.07 | 4.1 | 3.8 | 1.08 | 7.8 |
| 2 | 4.8 | 4.5 | 1.07 | 4.2 | 3.7 | 1.14 | 5.5 |
| 3 | 4.4 | 4.0 | 1.10 | 4.0 | 3.4 | 1.18 | 8.2 |
| 4 | 4.6 | 3.7 | 1.24 | 4.0 | 3.1 | 1.29 | 13.6 |
| 5 | 4.7 | 4.3 | 1.09 | 4.1 | 3.6 | 1.14 | 6.3 |
| 6 | 3.5 | 3.1 | 1.13 | 3.1 | 2.8 | 1.11 | 6.8 |
| 7 | 3.8 | 3.4 | 1.12 | 3.3 | 2.7 | 1.23 | 12.4 |
| 8 | 3.6 | 3.3 | 1.09 | 3.1 | 2.8 | 1.11 | 6.3 |
| 9 | 5.8 | 5.3 | 1.09 | 5.1 | 4.5 | 1.13 | 8.4 |
| 10 | 7.1 | 6.4 | 1.11 | 6.3 | 5.3 | 1.19 | 11.0 |
| 11 | 9.3 | 8.8 | 1.06 | 7.9 | 6.9 | 1.14 | 6.3 |

*1: 50% volume particle diameter
*2: 50% number average particle diameter
*3: Cumulative 75% volume average particle diameter
*4: Cumulative 75% number average particle diameter
*5: Number % of particles of 0.7 × Dp50 or less <Production of a Developer>

Developers 1-11 for evaluation were manufactured by mixing 10 parts by mass of each of toners 1-11 and 100 parts by mass of 45-micrometer ferrite carrier covered with a styrene-methacrylate copolymer.

<Evaluation>

The obtained photoreceptor and developer were combined as shown in Table 5 and mounted on Commercial color printer "MAGICOLOR 2200 DESKLASER (made by Minolta QMS company), and then a durability test was performed.

In detail, an original image in which a solid image, a character image and a halftone image are arranged in a mixed form were copied by 20,000 sheets, and a copy image on a initial sheet and every 5,000$^{th}$ sheet was evaluated. Evaluation items and evaluation criteria are shown below.

Charging device: Saw-tooth electrode

Image exposure light: Semiconductor laser (wavelength: 780 nm)

Development: Reversal developing method

Transfer: Using an intermediate transfer roller

Cleaning: Cleaning blade

Fixation: Heating fixation

Process speed: 100 mm/sec

Image Density

The reflective density of the image was measured by a densitometer RD-918, manufactured by Macbeth Co., Ltd., the density was expressed by a relative value when the reflective density of paper was set at 0. Since the image density was lowered as a lot of sheets were copied, the measurement was carried out for a black solid image printed after 20,000 sheets of printing.

A: The density of the black solid image was more than 1.2 (good).

B: The density of the black solid image was from 1.0 to 1.2 (no problem may be caused in the practical use).

C: The density of the black solid image was less than 1.0 (a problem may be caused in the practical use).

Fogging

Fog density was measured by measuring the reflection density of a solid white picture image by using Macbeth RD-918. The reflection density was evaluated with a relative density (the density of A4 paper which is not printed was set to 0.000).

A: The density is less than 0.010 (excellent).

B: The density is 0.010 or more and 0.020 or less (the level in which no problem may be occurred in a practical use).

C: The density is higher than 0.020 (the level in which there may be a problem in a practical use).

Image Fault

With regard to black spots and white omission, it was judged by how many picture image faults of black spots and white omission which has a long diameter of 0.4 mm or more and has a periodicity conforming with a cycle of a photoreceptor were counted per A4 size.

A: The frequency of black spots and white omission: less than 1 piece/A4 in all printed images (excellent).

B: The frequency of black spots and white omission: more than 2 pieces/A4 and less than 5 pieces/A4 occurred on one or more sheets (practically with no problem).

C: The frequency of black spots and white omission: more than 6 pieces/A4 occurred on one or more sheets (practically with problem).

Sharpness

A half tone image of each of 600 dpi (spot diameter of 50 nm), 1200 dpi (spot diameter of 30 nm) and 2400 dpi (spot diameter of 15 nm) which was obtained by changing the spot diameter of a laser beam, was printed on 20,000 sheets and evaluated.

A: A halftone picture image of each dpi is reproduced clearly (each dot becoming independent) up to 600 dpi-2400 dpi (high quality image characteristics is dramatically excellent).

B: A halftone picture image of each dpi is reproduced clearly (each dot becoming independent) up to 600 dpi-1200 dpi, however, the clearness of a halftone picture image of 2400 dpi is insufficient (high quality image characteristics is good).

C: A halftone picture image of 600 dpi is reproduced clearly, however, the clearness of a halftone picture image of 1200 dpi to 2400 dpi is insufficient (high quality image characteristics is slightly insufficient).

D: The clearness (independency of each dot) of a halftone picture image of 600 dpi is insufficient (high quality image characteristics is quite insufficient).

TABLE 5

| Combination No. | Photo-receptor No. | Developer No. | Image density | Fog | Image fault | Sharpness |
|---|---|---|---|---|---|---|
| 1 | 1 | 1 | A | A | A | A |
| 2 | 1 | 2 | A | A | A | A |
| 3 | 1 | 3 | A | A | A | A |
| 4 | 1 | 4 | A | B | B | B |
| 5 | 1 | 5 | A | A | A | A |
| 6 | 1 | 6 | A | A | A | A |
| 7 | 1 | 7 | A | B | B | B |
| 8 | 1 | 8 | A | A | A | A |
| 9 | 1 | 9 | A | A | A | A |
| 10 | 1 | 10 | A | B | B | B |
| 11 | 1 | 11 | A | A | A | A |
| 12 | 2 | 1 | A | A | A | A |
| 13 | 3 | 1 | A | B | A | A |
| 14 | 4 | 1 | A | A | A | A |
| 15 | 5 | 1 | B | A | C | B |
| 16 | 6 | 1 | B | B | A | C |
| 17 | 7 | 1 | A | A | B | A |
| 18 | 8 | 1 | A | A | A | B |
| 19 | 9 | 1 | B | B | C | A |
| 20 | 10 | 1 | A | B | A | C |
| 21 | 11 | 1 | A | A | A | A |
| 22 | 12 | 1 | A | A | A | A |
| 23 | 13 | 1 | A | B | B | A |
| 24 | 14 | 1 | A | A | A | A |
| 25 | 15 | 1 | A | B | B | A |
| 26 | 16 | 1 | A | A | B | A |
| 27 | 17 | 1 | B | C | C | B |
| 28 | 18 | 1 | B | C | C | B |
| 29 | 19 | 1 | C | B | A | C |

A result of Table 5 shows that any photoconductor in combinations (Nos. 1-14, 17, 18 and 21-26) each employing an organic photoconductor wherein a photosensitive layer is provided on a conductive support through an intermediate layer, the intermediate layer contains inorganic particles having number-average primary particle size of 5-200 nm, a layer thickness is larger than 6 μm and is not more than 25 m, a layer thickness of the photosensitive layer satisfies a condition of 8-18 μm and a layer thickness of the intermediate layer is greater than that of the photosensitive layer has acquired results of excellent evaluation for image density, photographic fog, image defects and sharpness, but, in combination No. 15 employing a photoconductor wherein a layer thickness of an intermediate layer is 4 μm, photographic fog and image defects are caused and sharpness is deteriorated. In combination No. 16 employing a photoconductor wherein a layer thickness of an intermediate layer is 27 μm, image density is lowered and sharpness is deteriorated. Further, even in the case of combination No. 19 employing a photoconductor wherein a layer thickness of the photosensitive layer is 6.5 μm, image density is lowered and sharpness is deteriorated.

In combination No. 20 employing a photoconductor wherein a layer thickness of the photosensitive layer is 19.5 μm, electric-charge carrier is diffused greatly because a layer thickness of a charge transport layer is large, and sharpness is deteriorated, resulting in a small effect of a latent image formed by using a laser with a short wavelength.

In combination (No. 27) employing a photoconductor wherein an inorganic particle of an intermediate layer is 2 μm, blocking characteristic of the intermediate layer is deteriorated because of deterioration of dispersibility of inorganic particles, and image defects and photographic fog are caused. In the same way, even in the case of a combination No. 28) employing a photoconductor wherein an inorganic particle of an intermediate layer is 220 nm, blocking characteristic of the intermediate layer is deteriorated and image defects and photographic fog are caused.

In combination No. 29 employing a photoconductor wherein an inorganic particle is not contained in an intermediate layer, image density is lowered and sharpness is deteriorated.

<Evaluation 2>

Evaluation 2 was conducted with the same combination of Evaluation 1 except that the semiconductor laser of the exposure device was changed to a light emitting diode (wavelength: 430 nm). Even when the light emitting diode was used as the image exposure light source, the evaluation result was as same as Evaluation 1.

<Evaluation 3>

Evaluation 3 was conducted with the same combination of Evaluation 1 except that the semiconductor laser of the exposure device was changed from a wavelength of 405 nm to a wavelength of 480 nm. Even when the semiconductor laser with the wavelength of 480 nm was used as the image exposure light source, the evaluation result was as same as Evaluation 1.

What is claimed is:

1. An image forming method, comprising the steps of:

charging uniformly an organic photoreceptor;

forming an electrostatic latent image with an imagewise exposing light source to emit a light beam having a wavelength of 350 to 500 nm onto the organic photoreceptor; and visualizing the electrostatic latent image to a toner image, wherein the organic photoreceptor, comprises:

a conductive support;

an intermediate layer provided on the conductive support, having a volume resistivity of $1 \times 10^8$ to $1 \times 10^{15}$ Ω· cm and containing inorganic particles having a number average primary particle diameter of 5 to 200 nm; and a photosensitive layer including a laminated charge generating layer and a laminated charge transporting layer is provided on the intermediate layer, wherein the photosensitive layer has a thickness B of 8 to 18 μm, the intermediate layer has a thickness A larger than the thickness B of the photosensitive layer and not larger than 25 μm, and the thickness A and the thickness B satisfy the following conditional expression $$1.1 < A/B < 3.0.$$

2. The image forming method described in claim 1, wherein the light beam is emitted based on digital image data and has a dot diameter of 10 to 50 μm.

3. The image forming method described in claim 1, wherein the toner image has a resolution of more than 600 dpi and up to 2500 dpi.

4. The image forming method described in claim 1, wherein the electrostatic latent image is visualized with a developer which contains toner particles in which a ratio (Dv50/Dp50) of a 50% volume particle diameter (Dv50) to a 50% number particle diameter (Dp50) is 1.0 to 1.15, a ratio of (Dv75/Dp75) of a cumulative 75% volume particle diameter (Dv75) calculated from a larger side of volume particle diameter to a cumulative 75% number particle diameter (Dp75) calculated from a larger side of number particle diameter is 1.0 to 1.20, and a number of toner particles having a particle diameter of 0.7×(Dp50) or less is 10 number% or less.

5. The image forming method described in claim 1, wherein the intermediate layer thickness A and the photosensitive layer thickness B satisfy the following formula:

$$1.5 < A/B < 2.5.$$

6. The image forming method described in claim 1, wherein thickness of the intermediate layer is larger than 8 μm and 20 μm or less.

7. The image forming method described in claim 1, wherein the thickness of the photosensitive layer is 10 μm to 17 μm.

8. The image forming method described in claim 1,wherein the intermediate layer, the electric charge generating layer and the electric charge transporting layer are laminated on the conductive support in this order.

9. The image forming method described in claim 1, wherein the number average primary particle diameter of the inorganic particles is 15 to 100 nm.

10. The image forming method described in claim 1, wherein in the intermediate layer, a volume ratio of the inorganic particles to a binder resin is 1.0 to 2.0 when the volume of the binder resin is 1.0.

11. The image forming method described in claim 1, wherein the inorganic particles are N-type semiconductive particles.

12. The image forming method described in claim 11, wherein the N-type semiconductive particles are one of titanium dioxide and zinc oxide.

13. The image forming method described in claim 12, wherein the titanium dioxide has a crystal type of an anatase type, a rutile type, and a brookite type.

14. The image forming method described in claim 11, wherein the N-type semiconductive particles are subjected to a surface treatment with one of a polymer containing methylhydrogensiloxane unit and a reactive organic silicon compound.

15. The image forming method described in claim 11, wherein the N-type semiconductive particles are subjected to a surface treatment with one of a polymer containing methylhydrogensiloxane unit and a reactive organic silicon compound after having been subjected to a surface treatment with at least one of alumina, silica and zirconia.

16. The image forming method described in claim 1, wherein the intermediate layer comprises polyamide as a binder resin.

* * * * *